US012740627B1

(12) United States Patent
Hu

(10) Patent No.: US 12,740,627 B1
(45) Date of Patent: Sep. 22, 2026

(54) WATERPROOF BAG

(71) Applicant: Shandong Longming Information Technology Co., Ltd, Qingdao City (CN)

(72) Inventor: Chengji Hu, Qingdao (CN)

(73) Assignee: Shandong Longming Information Technology Co., Ltd, Qingdao City (CN)

( * ) Notice: Subject to any disclaimer, the term of this patent is extended or adjusted under 35 U.S.C. 154(b) by 131 days.

(21) Appl. No.: 19/227,503

(22) Filed: Jun. 4, 2025

(30) Foreign Application Priority Data

May 8, 2025 (CN) ..... 202510593909.0

(51) Int. Cl.

| | |
|---|---|
| ***A45C 13/00*** | (2006.01) |
| ***A45C 3/00*** | (2006.01) |
| ***A45C 13/10*** | (2006.01) |
| ***A45F 3/00*** | (2006.01) |
| ***A45F 3/02*** | (2006.01) |

(52) U.S. Cl.
CPC ..... *A45C 13/008* (2013.01); *A45C 3/00* (2013.01); *A45C 13/1069* (2013.01); *A45F 3/005* (2013.01); *A45F 3/02* (2013.01); *A45C 2013/1015* (2013.01)

(58) Field of Classification Search
CPC ..... A45C 13/008; A45C 3/00; A45C 13/1069; A45C 2013/1015; A45F 3/005
USPC ..... 383/61.1
See application file for complete search history.

(56) References Cited

U.S. PATENT DOCUMENTS

| | | | | |
|---|---|---|---|---|
| 5,657,862 | A * | 8/1997 | Burke | A45C 11/325 248/205.2 |
| 5,816,709 | A * | 10/1998 | Demus | A45C 11/22 383/88 |
| 6,805,486 | B2 * | 10/2004 | Smith | B65D 33/24 383/88 |
| 8,905,987 | B2 * | 12/2014 | Murray | A61F 5/445 383/57 |
| 2009/0208148 | A1 * | 8/2009 | Doyle | B65D 33/24 383/86 |
| 2012/0301057 | A1 * | 11/2012 | Conant | B65D 31/04 383/42 |

* cited by examiner

*Primary Examiner* — Peter N Helvey
(74) *Attorney, Agent, or Firm* — Che-Yang Chen

(57) ABSTRACT

A waterproof bag includes a main body portion and a fastening assembly. The main body portion includes a front side portion and a rear side portion, wherein the rear side portion is configured to be foldable at least twice so as to switch the waterproof bag between an unfolded state, a first folded state, and a second folded state; the rear side portion includes a first folding portion and a second folding portion; the front side portion includes a first corresponding portion and a second corresponding portion; the fastening assembly includes a first fastening structure pair and a second fastening structure pair; wherein the first fastening structure pair comprises a first fastening element, a first mating element, a second fastening element and a second mating element; wherein the first fastening element and the second fastening element are disposed on the first folding portion.

22 Claims, 35 Drawing Sheets

WATERPROOF BAG

CROSS REFERENCE OF RELATED APPLICATION

This application is a non-provisional application that claims priority under 35 U.S.C. § 119 to China application number CN202510593909.0, filing date May 8, 2025, wherein the entire content of which is expressly incorporated herein by reference

BACKGROUND OF THE PRESENT INVENTION

Field of Invention

The present invention relates to the technical filed of container devices, and more particularly to a waterproof bag.

Description of Related Arts

A waterproof bag is an apparatus with certain water resistance used for storing items, applicable in various scenarios such as daily life and outdoor activities. In different application scenarios, requirements for waterproof bags vary. For instance, in outdoor water activities like fishing, paddleboarding, and kayaking, higher standards for waterproofing and airtightness are required to prevent water from entering the bag and damaging its contents.

Currently, some waterproof bags have specific designs for waterproofing and sealing. However, there are still some issues. Specifically, some waterproof bags are equipped with airtight zipper structures or multi-layer foldable structures, but these designs often come with high production costs. Additionally, they may be difficult to open or close with one hand during actual use, or their airtightness may be compromised after being opened.

SUMMARY OF THE PRESENT INVENTION

The application is advantageous in that it provides a waterproof bag s, which can ensure its airtightness through the cooperation of folding and fastening structures, thereby enhancing its waterproof performance to a certain extent.

Another advantage of this application is to provide a waterproof bag that enhances its airtightness through the cooperation of multiple types and positions of fastening structures, thereby improving its waterproofness to a certain extent.

According to the present application, the foregoing and other objects and advantages are attained by a waterproof bag, comprising:

a main body portion, made of waterproof material, and comprising a front side portion and a rear side portion, and having an accommodating cavity; wherein the front side portion and the rear side portion are connected to each other; the accommodating cavity is located between the front side portion and the rear side portion and has an opening; the opening is located between the upper edge of the front side portion and the rear side portion; the rear side portion extends beyond the front side portion in the height direction of the main body portion and is configured to be foldable at least twice so as to switch the waterproof bag between an unfolded state, a first folded state, and a second folded state; the rear side portion comprises a first folding portion and a second folding portion; the first folding portion extends beyond the front side portion in the height direction of the main body portion; the second folding portion is located below the first folding portion; the front side portion comprises a first corresponding portion and a second corresponding portion; wherein the first corresponding portion is opposite to the second folding portion; the second corresponding portion is located below the first corresponding portion; and a fastening assembly, comprising a first fastening structure pair and a second fastening structure pair; wherein the first fastening structure pair comprises a first fastening element and a first mating element; the second fastening structure pair comprises a second fastening element and a second mating element; wherein the first fastening element and the second fastening element are disposed on the first folding portion; the first mating element and the second mating element are disposed on the main body portion;

when the waterproof bag is in the unfolded state, the upper edge of the rear side portion is higher than the upper edge of the front side portion in the height direction of the main body portion; when the waterproof bag is in the first folded state, the first folding portion is folded downward to oppose the first corresponding portion; and the first fastening element couples with the first mating element to close the opening; when the waterproof bag is in the second folded state, the first folding portion, the first corresponding portion, and the second folding portion are folded downward to oppose the second corresponding portion; and the second fastening element couples with the second mating element.

In one embodiment, the first fastening element comprises a first magnetic attraction element; the first mating element comprises a second magnetic attraction element; the second fastening element is located behind the first fastening element; the second fastening structure pair is VELCRO; the second mating element is disposed on the second corresponding portion; one of the second fastening element and the second mating element has multiple hooks, and the other has multiple loops.

In one embodiment, the first folding portion comprises a first rear main structural layer; the first fastening element is located on the front side of the first rear main structural layer; the second fastening element is set and exposed on the rear side of the first rear main structural layer.

In one embodiment, the first mating element is disposed on the first corresponding portion.

In one embodiment, the first mating element is disposed on the second folding portion.

In one embodiment, the second folding portion comprises a second rear main structural layer, the first mating element is disposed on the front side of the second rear main structural layer, located between the second folding portion and the first corresponding portion.

In one embodiment, the second folding portion comprises a second rear main structural layer, the first mating element is disposed on the rear side of the second rear main structural layer.

In one embodiment, the waterproof bag further comprises at least one auxiliary magnetic attraction element; wherein the auxiliary magnetic attraction element is disposed on the second corresponding portion, and when the main body portion is in the second folded state, the first magnetic attraction element and the auxiliary magnetic attraction element attract each other.

In one embodiment, the first fastening element comprises a first magnetic attraction element; the first mating element comprises a second magnetic attraction element; the second fastening element comprises a third magnetic attraction element; the second mating element comprises a fourth magnetic attraction element.

In one embodiment, the first magnetic attraction element and the third magnetic attraction element are the same magnetic attraction element.

In one embodiment, the second mating element is disposed on the second corresponding portion.

In one embodiment, the rear side portion further comprises a rear spare installation portion, the rear spare installation portion is located below the second folding portion and opposite to the second corresponding portion, and the second mating element is disposed on the rear spare installation portion.

In one embodiment, the fastening assembly further comprises an additional magnetic attraction element, which faces and attracts the second magnetic attraction element when the waterproof bag is in the unfolded state.

In one embodiment, the waterproof bag further comprises at least one air column bag, wherein at least one air column bag is disposed between the front side portion and the rear side portion.

In one embodiment, at least one air column bag is disposed between the first corresponding portion and the second corresponding portion and located on the rear side of the front side portion, facing the rear side portion.

In one embodiment, at least one air column bag is disposed below the second folding portion and located on the front side of the rear side portion, facing the front side portion.

In one embodiment, at least one air column bag is disposed between the first folding portion and the second folding portion and adjacent to the opening.

In one embodiment, the waterproof bag further comprises a front additional film and a rear additional film, wherein the front additional film is connected to the front side portion and located on the rear side of the front side portion; the rear additional film is connected to the rear side portion and located on the front side of the rear side portion; the front additional film and the rear additional film are opposite.

In one embodiment, the fastening assembly further comprises at least one fastening strap adjustably disposed between the front side portion and the rear side portion, and configured to be switchable between a constrained state and a released state; when the fastening strap is in the constrained state, it prevents the waterproof bag from switching from the second folded state to the first folded state or the unfolded state; when the fastening strap is in the released state, it allows the waterproof bag to switch from the second folded state to the first folded state or the unfolded state.

In accordance with another aspect of the application, the present application provides a waterproof bag, comprising:

a main body portion, made of waterproof material, comprising a front side portion and a rear side portion, and having an accommodating cavity; wherein the front side portion and the rear side portion are connected to each other; the accommodating cavity is located between the front side portion and the rear side portion and has an opening; the opening is located between the upper edge of the front side portion and the rear side portion; the front side portion and the rear side portion are configured to be foldable at least once so as to switch the waterproof bag between an unfolded state and a first folded state; the rear side portion comprises a first folding portion and a rear installation portion; the rear installation portion is located below the first folding portion; the front side portion comprises a first corresponding portion and a front installation portion; the front installation portion is located below the first corresponding portion; wherein the first corresponding portion is opposite to the first folding portion; the front installation portion is opposite to the rear installation portion; and a fastening assembly comprising a first fastening element and a first mating element; the first fastening element is disposed on the first folding portion; the first mating element is disposed on the main body portion;

when the waterproof bag is in the first folded state, the first folding portion and the first corresponding portion are folded downward to oppose the front installation portion, and the first fastening element opposes and couples with the first mating element.

In one embodiment, the first mating element is disposed on the rear installation portion; the first fastening element comprises a first magnetic attraction element; the first mating element comprises a second magnetic attraction element.

In one embodiment, the fastening assembly further comprises a second fastening element and a second mating element; the first mating element and the second mating element are disposed on the front installation portion; the second fastening element is disposed on the rear installation portion; when the waterproof bag is in the unfolded state, the second fastening element opposes and couples with the second mating element.

In one embodiment, the first fastening element comprises a first magnetic attraction element; the second fastening element comprises a second magnetic attraction element; the fastening assembly comprises a third magnetic attraction element, and the third magnetic attraction element is a shared magnetic attraction element for the first mating element and the second mating element.

In one embodiment, the fastening assembly further comprises a second fastening element and a second mating element; the first mating element is disposed on the first corresponding portion; the second fastening element is disposed on the rear installation portion; the second mating element is disposed on the front installation portion; when the waterproof bag is in the unfolded state, the first fastening element opposes and couples with the first mating element; the second fastening element opposes and couples with the second mating element; when the waterproof bag is in the first folded state, the first mating element opposes and couples with the second mating element.

In one embodiment, the first fastening element comprises a first magnetic attraction element; the first mating element comprises a second magnetic attraction element; the second fastening element comprises a third magnetic attraction element; the second mating element comprises a fourth magnetic attraction element.

In accordance with another aspect of the application, the present application provides a waterproof bag, comprising:

a main body portion, made of waterproof material, comprising a front side portion and a rear side portion, and having an accommodating cavity; wherein the front side portion and the rear side portion are connected to each other; the accommodating cavity is located between the front side portion and the rear side portion and has an opening;

a front additional film, connected to the front side portion and located on the rear side of the front side portion; and a rear additional film, connected to the rear side portion and located on the front side of the rear side portion; the front additional film and the rear additional film are opposite.

In one embodiment, the waterproof bag further comprises at least one air column bag, wherein at least one of the air column bags is disposed between the front side portion and the rear side portion.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
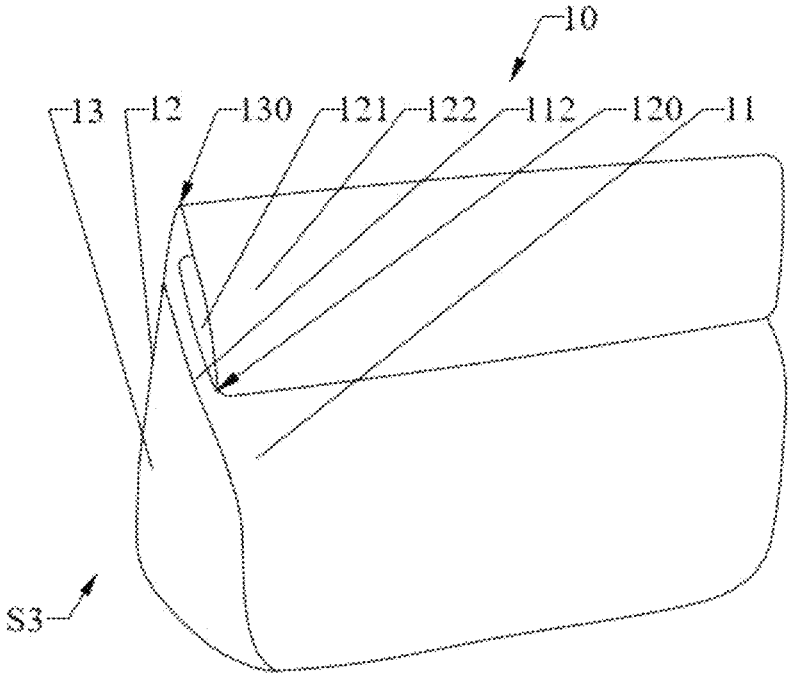
FIG. 1 is a perspective view of a waterproof bag according to an embodiment of the present application.

The following will be combined with the drawings in the embodiments of the present application to clearly and completely describe the technical solutions in the embodiments of the present application. Obviously, the described embodiments are only part of the embodiments of the present application, not all of the embodiments. According to the embodiments in the present application, all other embodiments obtained by ordinary technicians in this field without creative work are within the scope of protection of this application.

The terms "first", "second", etc. in this application are used to distinguish different objects rather than to describe a specific order. In addition, the terms "comprise", "have" and any variations thereof are intended to cover non-exclusive inclusions.

Although terms such as "front," "back," "left," "right," "top," and "bottom" may be used in this specification when describing various exemplary features and components, these terms are used herein for convenience, based on the example orientations shown in the Figs, and/or typical directions of use. Nothing in this specification should be construed as requiring a specific three-dimensional or spatial orientation of structures to fall within the scope of the claims.

It should be noted that when a certain element is fixed to another element, it comprises directly fixing the element to the other element, or fixing the element to the other element through at least one other element in the middle. When an element is connected to another element, it comprises directly connecting the element to the other element, or connecting the element to the other element through at least one other element in the middle.

Referring to FIGS. 1 to 42 of the drawings, the present application provides a waterproof bag having certain waterproof and airtight properties, making it suitable for use in water-based activities. Of course, the waterproof bag may also be used in other application scenarios and still remains waterproof in such other applications. The waterproof bag comprises a main body portion 10 and a fastening assembly 20. The main body portion 10 is made of waterproof material. The fastening assembly 20 is configured to fasten the waterproof bag so as to prevent fluid from entering into an interior of the main body portion 10, thereby improving the airtightness of the waterproof bag.

Specifically, the main body portion 10 comprises a front side portion 11 and a rear side portion 12, and defines an accommodating cavity 110. The front side portion 11 and the rear side portion 12 are connected to and face each other. The accommodating cavity 110 is located between the front side portion 11 and the rear side portion 12, and defines an opening 1101. The accommodating cavity 110 is configured to accommodate items, such as a mobile phone, keys, tissues, a water bottle, etc. The opening 1101 is located between the upper edge of the front side portion 11 and the rear side portion 12.

The front side portion 11 and the rear side portion 12 are directly or indirectly connected. In one embodiment of the present application, the front side portion 11 is directly connected to the rear side portion 12; the left side edge of the front side portion 11 is connected to the left side edge of the rear side portion 12; the right side edge of the front side portion 11 is connected to the right side edge of the rear side portion 12; the lower side edge of the front side portion 11 is connected to the lower side edge of the rear side portion 12. The front side portion 11 and the rear side portion 12 together define the accommodating cavity 110. In this embodiment, both the front side portion 11 and the rear side portion 12 are made of waterproof material and are connected by heat pressing technology, which can improve the airtightness and waterproof performance of the waterproof bag to some extent.

In another embodiment of the present application, the main body portion 10 further comprises a first side portion 13, a second side portion 14, and a lower side portion 15. The first side portion 13 is connected between the left side of the front side portion 11 and the left side of the rear side portion 12. The second side portion 14 is connected between the right side of the front side portion 11 and the right side of the rear side portion 12. The lower side portion 15 is connected between the lower side of the front side portion 11 and the lower side of the rear side portion 12. The front side portion 11, the rear side portion 12, the first side portion 13, the second side portion 14, and the lower side portion 15 together define the accommodating cavity 110. In this embodiment, the front side portion 11, the rear side portion 12, the first side portion 13, the second side portion 14, and the lower side portion 15 are all made of waterproof material and are connected by heat pressing technology, which can improve the airtightness and waterproof performance of the waterproof bag to some extent.

It should be understood that the respective side portions of the main body portion 10 (e.g., the front side portion 11, the rear side portion 12, the first side portion 13, the second side portion 14, the lower side portion 15) may be connected by other methods.

In some embodiments of the present application, for example, in the embodiment illustrated in FIGS. 1 to 24, the rear side portion 12 extends beyond the front side portion 11 in the height direction of the main body portion 10, and is configured to be foldable at least twice so as to enable the waterproof bag to switch between an unfolded state S1, a first folded state S2, and a second folded state S3.

Accordingly, the rear side portion 12 comprises a first folding portion 121 and a second folding portion 122. The first folding portion 121 extends beyond the front side portion 11 in the height direction of the main body portion 10. The second folding portion 122 is located below the first folding portion 121. The front side portion 11 comprises a first corresponding portion 111 and a second corresponding portion 112. The first corresponding portion 111 is opposite to the second folding portion 122. The second corresponding portion 112 is located below the first corresponding portion 111.

The fastening assembly 20 prevents fluid from entering the accommodating cavity 110 of the main body portion 10 through the opening 1101 by cooperation of multiple fastening structure pairs at different positions, thereby improving the airtightness and waterproof performance of the waterproof bag. Accordingly, the fastening assembly 20 comprises a first fastening structure pair 21 and a second fastening structure pair 22. The first fastening structure pair 21 comprises a first fastening element 211 and a first mating element 212. The second fastening structure pair 22 comprises a second fastening element 221 and a second mating element 222. The first fastening element 211 and the second fastening element 221 are disposed on the first folding portion 121; the second fastening element 221 is located behind the first fastening element 211; the first mating element 212 and the second mating element 222 are disposed on the main body portion 10; the second mating element 222 is disposed on the main body portion 10.

Figure 2:
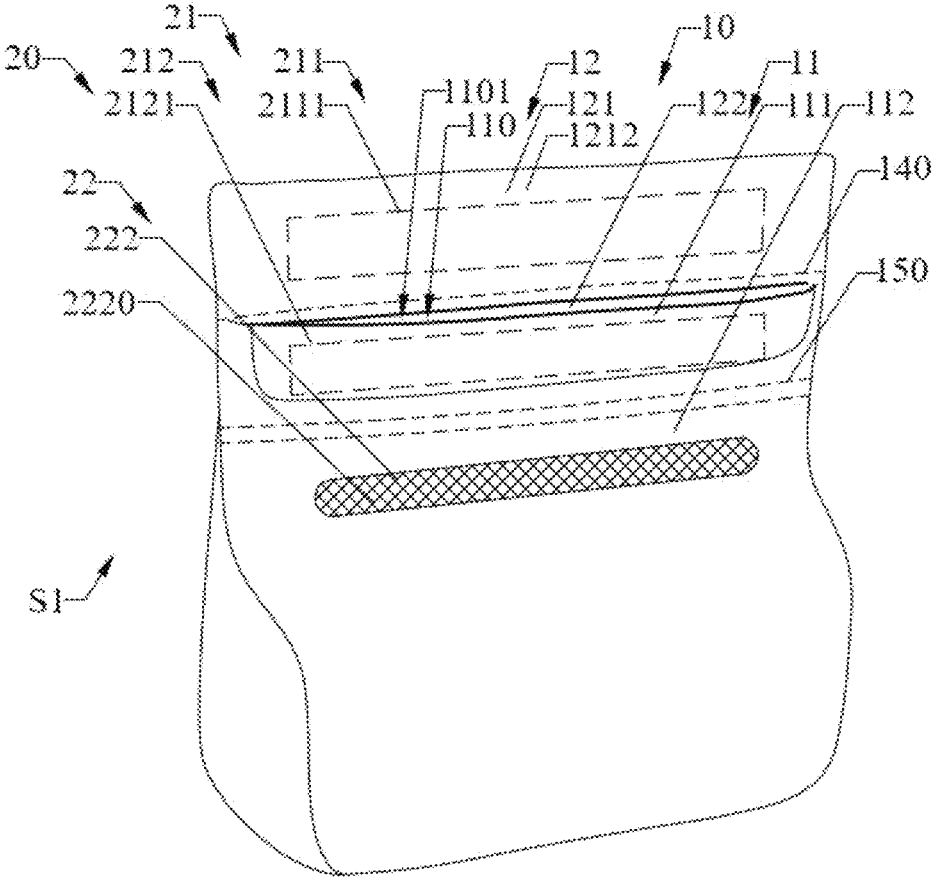
FIG. 2 is a perspective view of the waterproof bag according to a first embodiment of the present application in an unfolded state.
Figure 4:
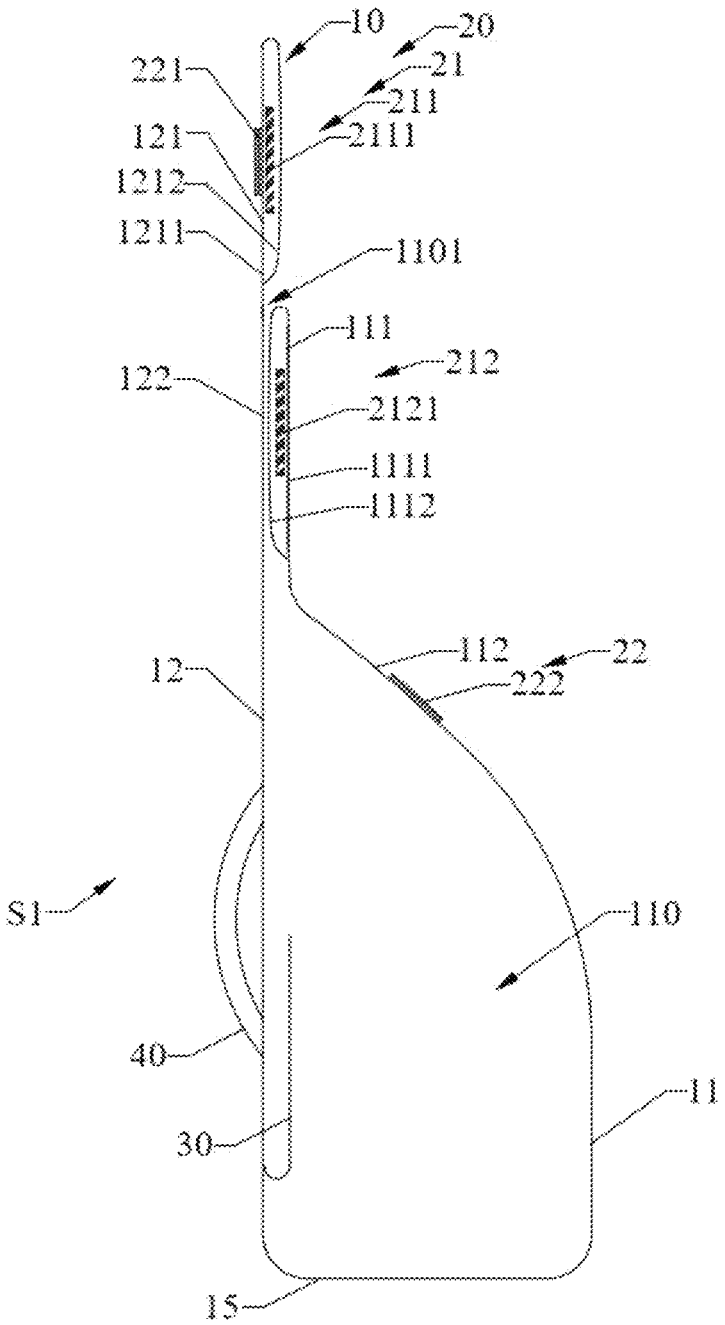
FIG. 4 is a cross-sectional view of the waterproof bag according to the first embodiment of the present application in an unfolded state.
Figure 5:
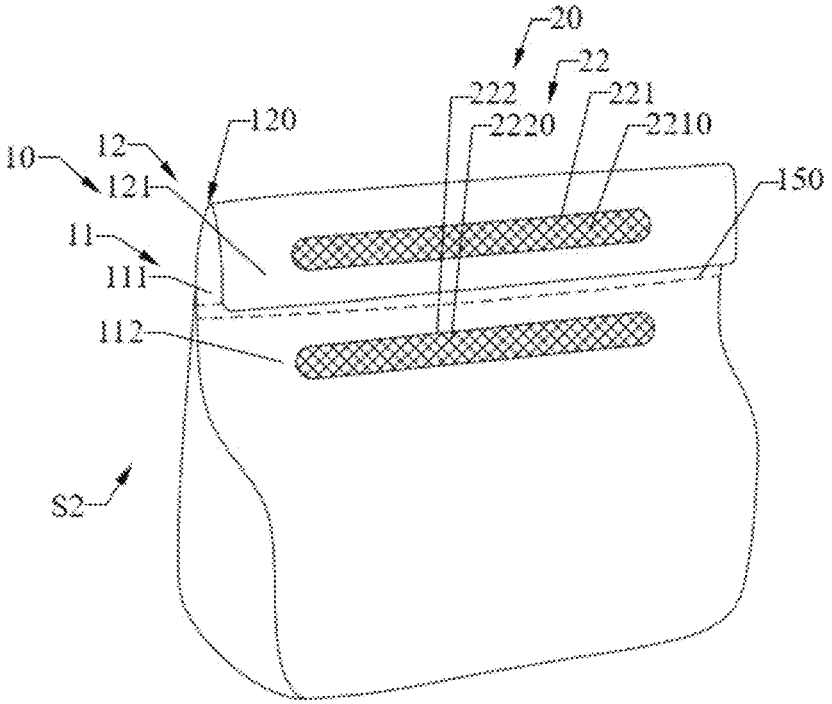
FIG. 5 is a perspective view of the waterproof bag according to the first embodiment of the present application in a first folded state.
Figure 6:
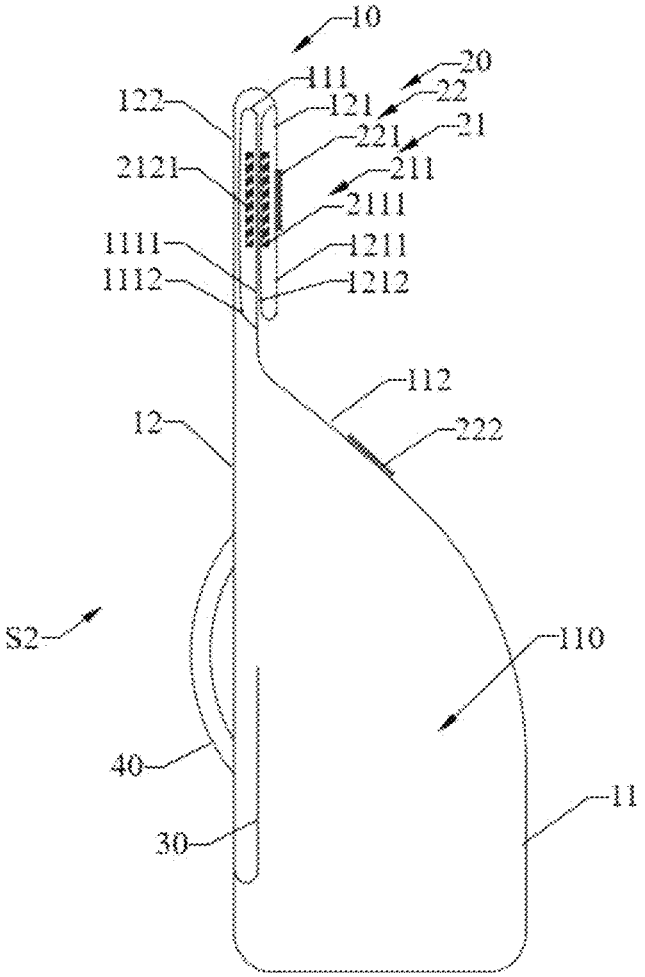
FIG. 6 is a cross-sectional view of the waterproof bag according to the first embodiment of the present application in a first folded state.
Figure 7:
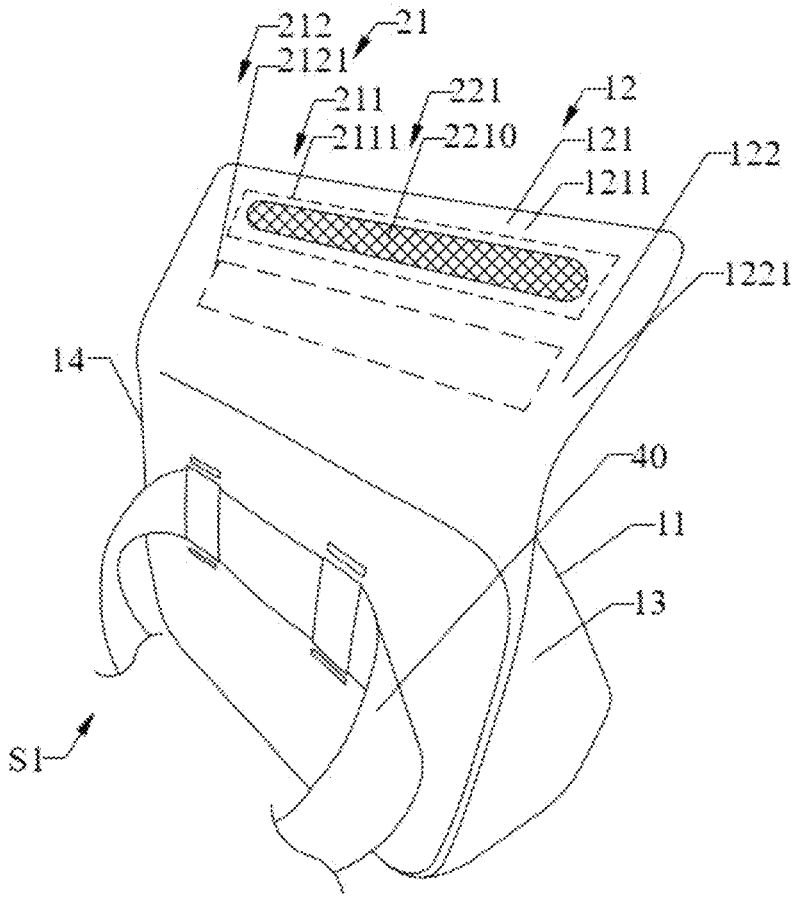
FIG. 7 is a perspective view of the waterproof bag according to a second embodiment of the present application in an unfolded state.
Figure 8:
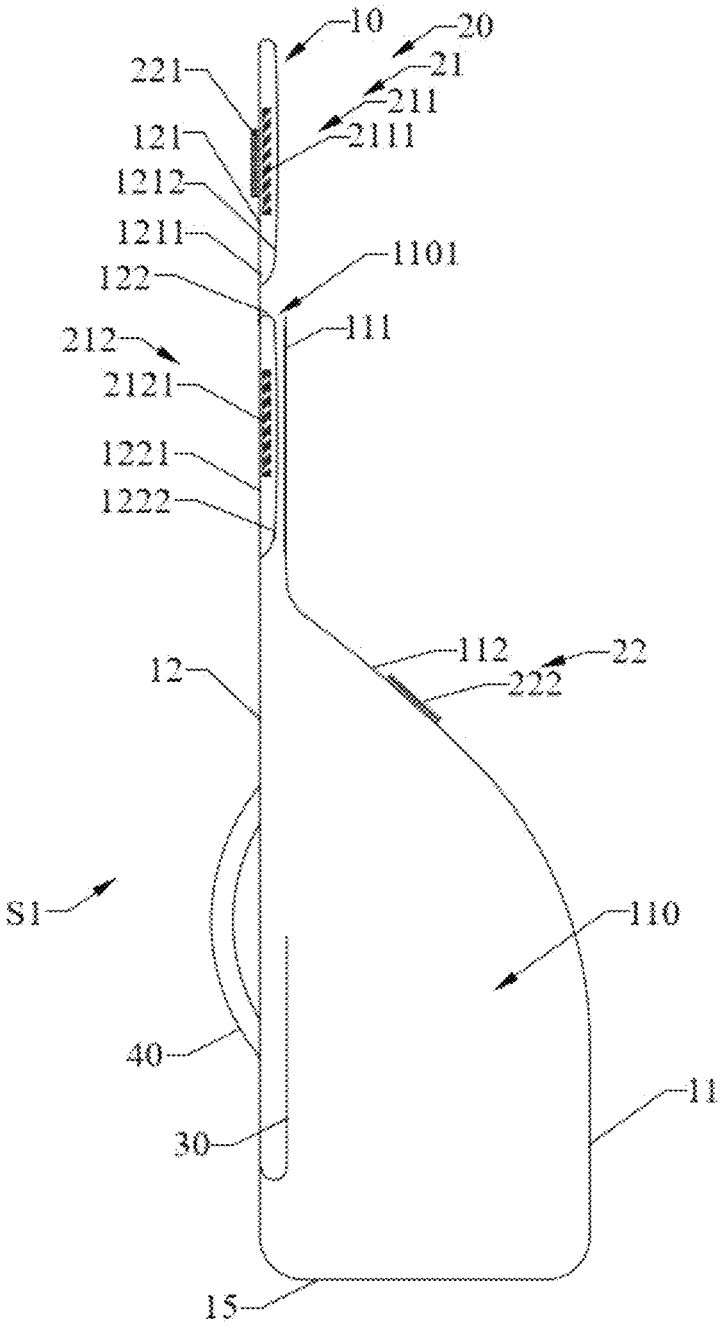
FIG. 8 is a cross-sectional view of the waterproof bag according to the second embodiment of the present application in an unfolded state.
Figure 9:
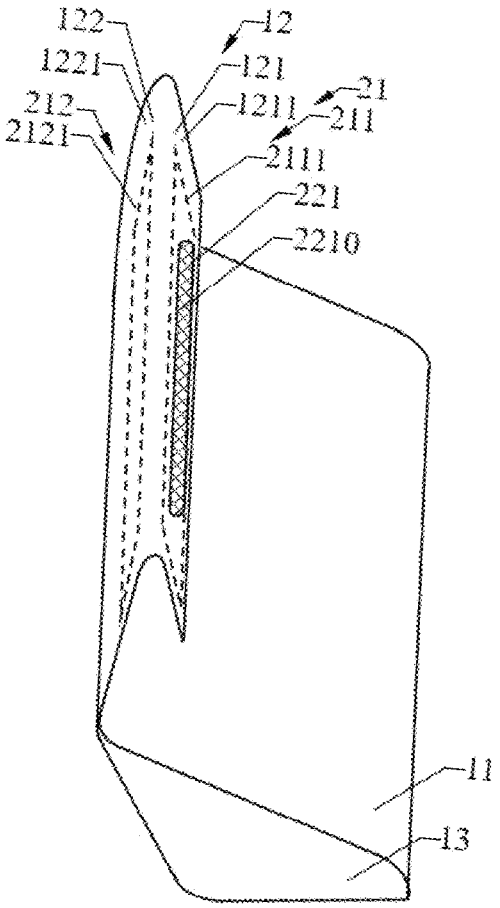
FIG. 9 is a perspective view of the waterproof bag according to the second embodiment of the present application when the first folding section is folded downward.
Figure 10:
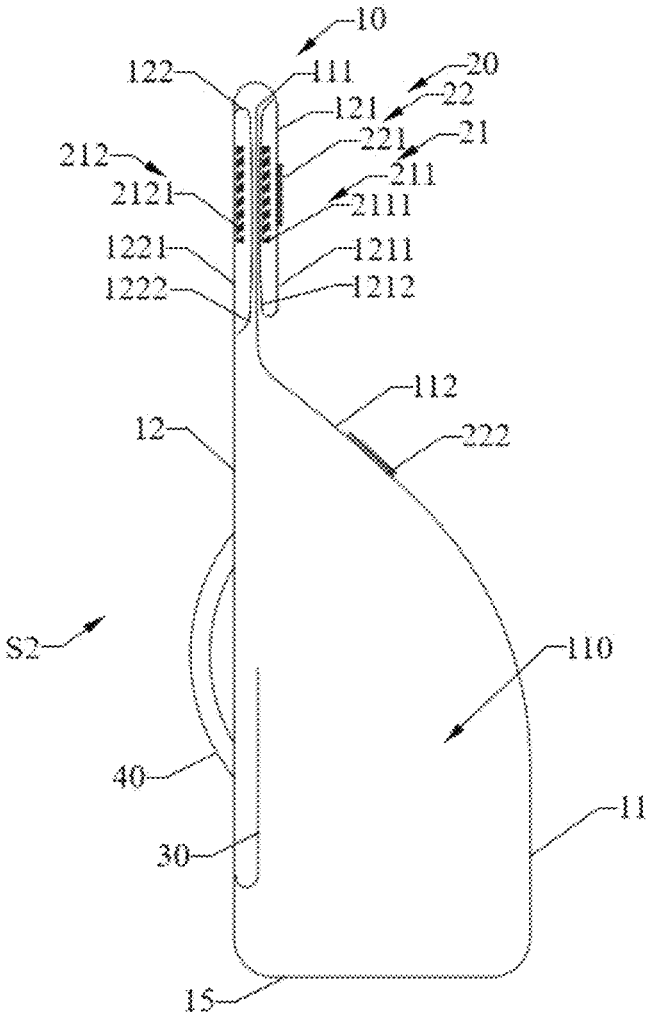
FIG. 10 is a cross-sectional view of the waterproof bag according to the second embodiment of the present application in a first folded state.

As shown in FIGS. 2 and 4, when the waterproof bag is in the unfolded state S1, the upper edge of the rear side portion 12 is higher than the upper edge of the front side portion 11 in the height direction of the main body portion 10. When the waterproof bag is in the first folded state S2, the first folding portion 121 is folded downward to face the first corresponding portion 111 (as shown in FIGS. 5 and 6). When the waterproof bag is in the first folded state S2, a first bend portion 120 is formed between the first folding portion 121, the second folding portion 122, and the first corresponding portion 111; and the first fastening element 211 is coupled with the first mating element 212 so as to close the opening 1101. When the waterproof bag is in the second folded state S3, the first folding portion 121, the first corresponding portion 111, and the second folding portion 122 are folded downward to face the second corresponding portion 112; the second corresponding portion 112 and the first folding portion 121 and the first corresponding portion 111 form a second bend portion 130 (as shown in FIG. 1); and the second fastening element 221 is coupled with the second mating element 222.

It is worth mentioning that the present application ensures the airtightness of the waterproof bag through the cooperation of folding and the fastening structure pairs, which can improve its waterproof performance to some extent. Specifically, the present application not only closes the opening 1101 via the first fastening structure pair 21 so that fluid is less likely to enter the main body portion 10, but also makes the passage for fluid entering the opening 1101 winding and tortuous through at least two foldings, and causes the front side portion 11 and the rear side portion 12 to be tightly pressed against each other, further making it difficult for fluid to enter the main body portion 10.

More specifically, when the waterproof bag is in the second folded state S3, fluid flows upward from below toward the second fastening structure pair 22 and is blocked by the second fastening structure pair 22 from flowing toward the opening 1101; even if a small amount of fluid passes through the second fastening structure pair 22 to the second bend portion 130, it is blocked by the second bend portion 130 from flowing toward the opening 1101; even if a small amount of fluid flows downward from the second bend portion 130 to the first bend portion 120, it is blocked by the first bend portion 120 from flowing toward the opening 1101; and the first fastening structure pair 21 closes the opening 1101, thus preventing fluid from entering the accommodating cavity 110 of the main body portion 10.

It should be understood that the structures of the first fastening structure pair 21 and the second fastening structure pair 22 may affect the fastening performance of the fastening assembly 20, and thus influence the airtightness and waterproof performance of the waterproof bag.

In some embodiments of the present application, for example, in the embodiment illustrated in FIGS. 1 to 14, the first fastening structure pair 21 mainly achieves fastening through a magnetic attraction structure; the second fastening structure pair 22 mainly achieves fastening through VELCRO. In some embodiments of the present application, for example, in the embodiment illustrated in FIGS. 15 to 20, the first fastening structure pair 21 mainly achieves fastening through a magnetic attraction structure; the second fastening structure pair 22 also mainly achieves fastening through a magnetic attraction structure.

It is worth mentioning that, in the present application, the term "magnetic attraction structure" refers to a structure capable of generating a magnetic field (e.g., an electromagnet, a permanent magnet) or a structure that can be attracted by a magnetic material, such as an iron-made structure. Accordingly, the first magnetic attraction element 2111, the first magnetic attraction part 21111, the second magnetic attraction part 21112, the third magnetic attraction part 21113, the first mating element 212, the second magnetic attraction element 2121, the fifth magnetic attraction part 21211, the sixth magnetic attraction part 21212, the seventh magnetic attraction part 21213, the third magnetic attraction element 2211, the fourth magnetic attraction element 2221, and the fifth magnetic attraction element 2222 mentioned below may be structures capable of generating a magnetic field, or structures that can be attracted by a magnetic material. Among two mutually attracting magnetic attraction structures, at least one is capable of generating a magnetic field. For example, if the first magnetic attraction element 2111 and the second magnetic attraction element 2121 attract each other, at least one of them is capable of generating a magnetic field. For instance, both the first magnetic attraction element 2111 and the second magnetic attraction element 2121 are capable of generating a magnetic field, or one of them is capable of generating a magnetic field while the other is an iron-made structure that can be attracted by a magnetic material.

Accordingly, when the first fastening structure pair 21 mainly achieves fastening through a magnetic attraction structure and the second fastening structure pair 22 mainly achieves fastening through VELCRO, the first fastening element 211 comprises a first magnetic attraction element 2111; the first mating element 212 comprises a second magnetic attraction element 2121; when the main body portion 10 is in the first folded state S2, the first magnetic attraction element 2111 and the second magnetic attraction element 2121 attract each other, thereby closing the opening 1101. The second fastening structure pair 22 is VELCRO; the second mating element 222 is disposed on the second corresponding portion 112; one of the second fastening element 221 and the second mating element 222 has a plurality of hooks 2210, and the other has a plurality of loops 2220. For example, in one embodiment of the present application, the second fastening element 221 is provided with the hooks 2210; the second mating element 222 is provided with the loops 2220. In another embodiment of the present application, the second fastening element 221 is provided with the loops 2220; the second mating element 222 is provided with the hooks 2210. When the main body portion 10 is in the second folded state S3, the hooks 2210 and the loops 2220 are fastened together.

It is worth mentioning that, in the embodiments of the present application, the loops 2220 of the VELCRO have a certain degree of water repellency and can prevent most water from entering the accommodating cavity 110 of the waterproof bag; the first magnetic attraction element 2111 and the second magnetic attraction element 2121 can tightly close the opening 1101 through magnetic attraction. Thus, the embodiments of the present application improve the airtightness of the waterproof bag through the cooperation of different types of fastening structure pairs, which can improve its waterproof performance to some extent.

When the first fastening structure pair 21 mainly achieves fastening through a magnetic attraction structure and the second fastening structure pair 22 also mainly achieves fastening through a magnetic attraction structure, the first fastening element 211 comprises a first magnetic attraction element 2111; the first mating element 212 comprises a second magnetic attraction element 2121; when the main body portion 10 is in the first folded state S2, the first magnetic attraction element 2111 and the second magnetic attraction element 2121 attract each other, thereby closing the opening 1101. The second fastening element 221 comprises a third magnetic attraction element 2211; the second mating element 222 comprises a fourth magnetic attraction element 2221; when the main body portion 10 is in the second folded state S3, the third magnetic attraction element 2211 and the fourth magnetic attraction element 2221 attract each other, thereby being fastened together. The first magnetic attraction element 2111 and the third magnetic attraction element 2211 may be the same magnetic attraction element.

Figure 41:
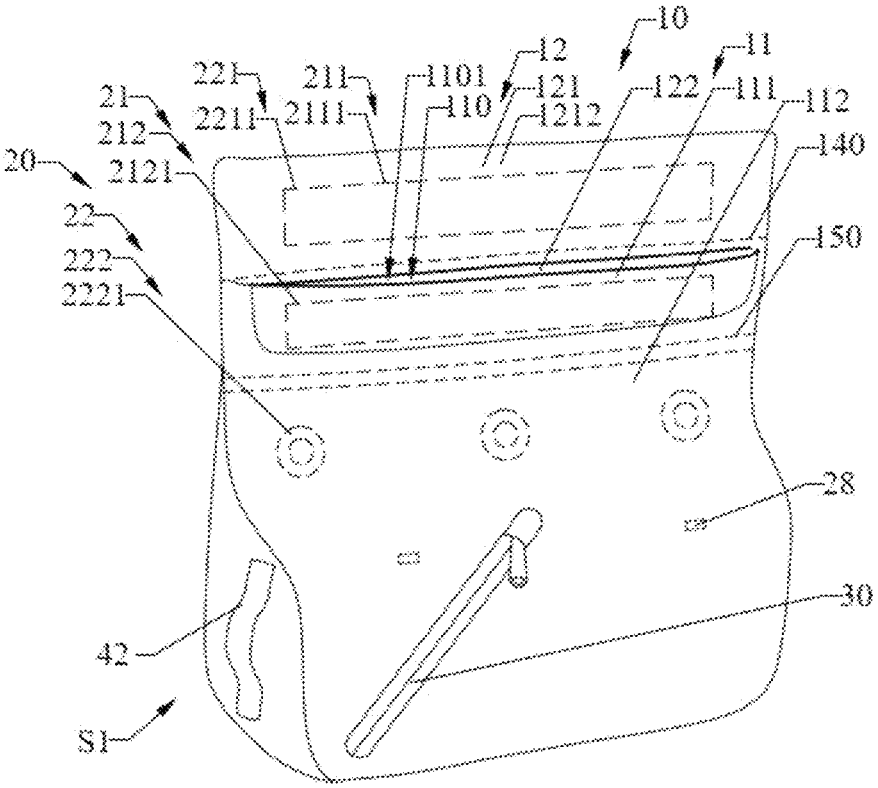
FIG. 41 is a perspective view of the waterproof bag according to a Twenty-fourth embodiment of the present application.
Figure 42:
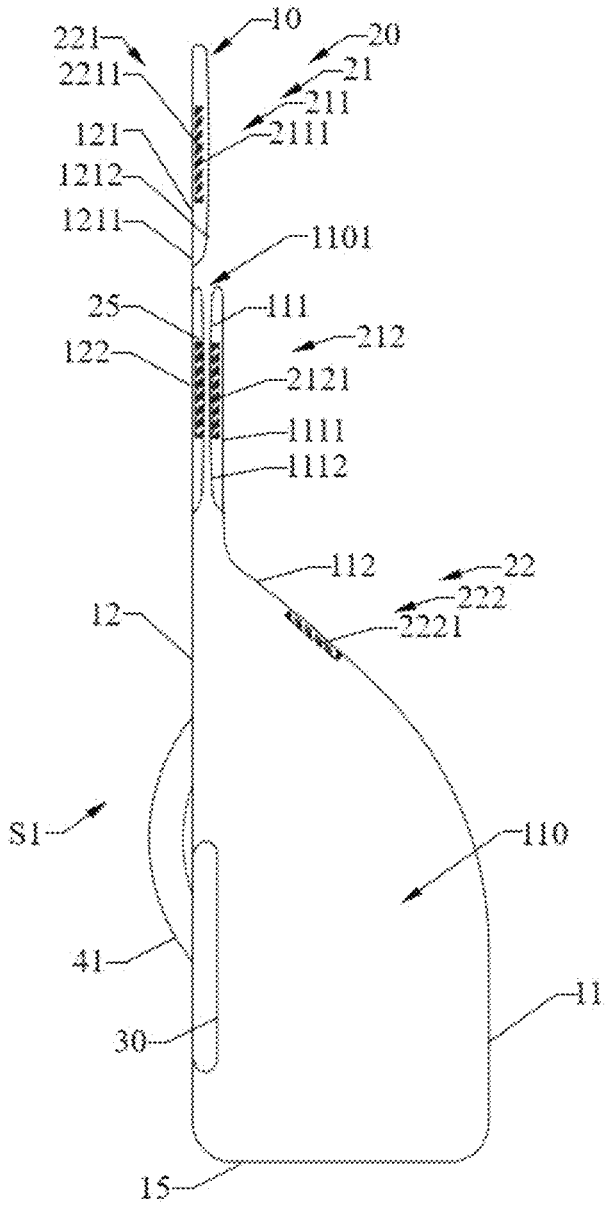
FIG. 42 is a cross-sectional view of the waterproof bag according to a Twenty-fourth embodiment of the present application.

It is worth mentioning that, in one embodiment of the present application, as shown in FIGS. 41 and 42, the fastening assembly 20 further comprises an additional magnetic attraction element 25. When the waterproof bag is in the unfolded state S1, the additional magnetic attraction element 25 faces the second magnetic attraction element 2121. For example, the second magnetic attraction element 2121 is disposed on the first corresponding portion 111, and the additional magnetic attraction element 25 is disposed on the second folding portion 122. The additional magnetic attraction element 25 and the second magnetic attraction element 2121 attract each other so as to close the opening 1101 when the waterproof bag is in the unfolded state S1. At least one of the additional magnetic attraction element 25 and the second magnetic attraction element 2121 is capable of generating a magnetic field. For example, both the additional magnetic attraction element 25 and the second magnetic attraction element 2121 are capable of generating a magnetic field, or one of them is capable of generating a magnetic field while the other is an iron-made structure that can be attracted by a magnetic material.

Accordingly, any embodiment in which the first fastening structure pair 21 achieves fastening through a magnetic attraction structure may be combined with any embodiment in which the second fastening structure pair 22 achieves fastening through VELCRO, or with any embodiment in which the second fastening structure pair 22 achieves fastening through a magnetic attraction structure.

The first fastening structure pair 21 and the second fastening structure pair 22 employed in the present application are adapted to be opened with one hand by a user, facilitating operation for the user.

In the embodiments of the present application, the shape and size of the first magnetic attraction element 2111 and the second magnetic attraction element 2121 are designed according to actual requirements.

Figure 13:
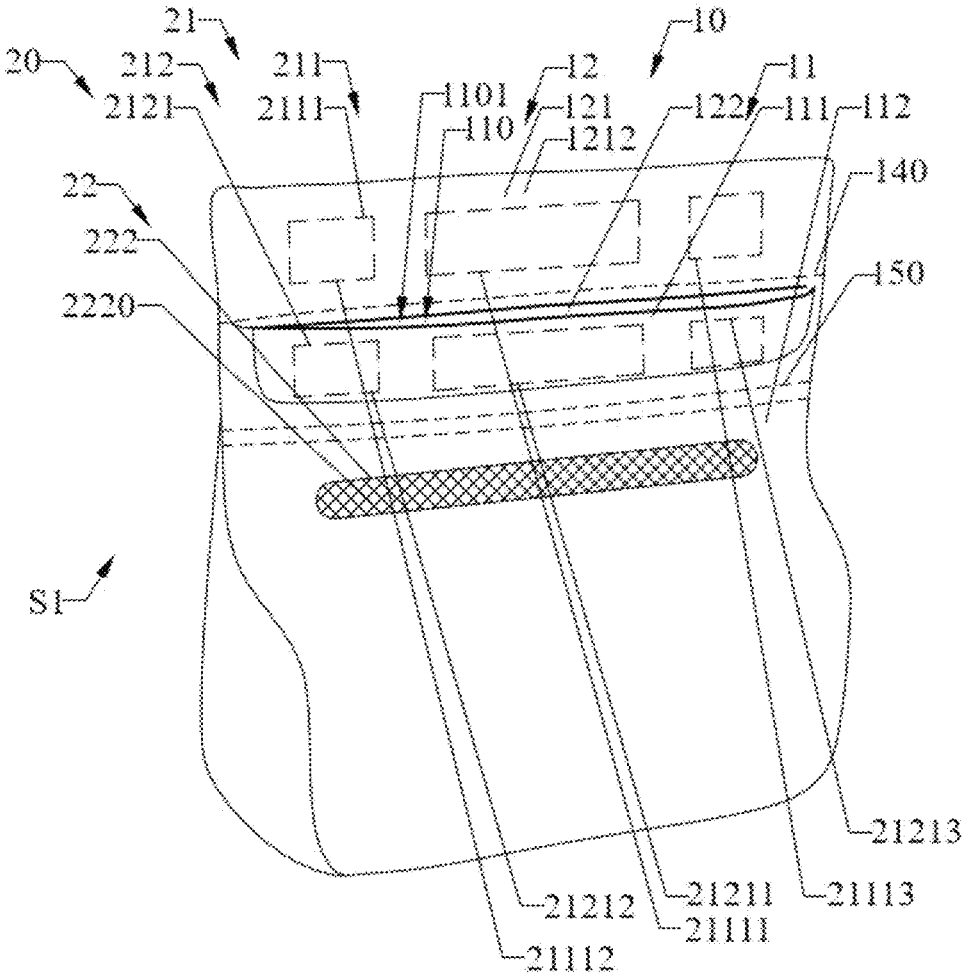
FIG. 13 is a perspective view of the waterproof bag according to a fourth embodiment of the present application in an unfolded state.

In one embodiment of the present application, as shown in FIG. 2, the first magnetic attraction element 2111 is strip-shaped and has an integral structure. In another embodiment of the present application, the first magnetic attraction element 2111 comprises a plurality of magnetic attraction parts, such as a first magnetic attraction part 21111, a second magnetic attraction part 21112, a third magnetic attraction part 21113, a fourth magnetic attraction part, etc. The distribution of the respective magnetic attraction parts may be set according to actual requirements. For example, as shown in FIG. 13, the second magnetic attraction part 21112 is located to the left of the first magnetic attraction part 21111 and spaced apart from it; the third magnetic attraction part 21113 is located to the right of the first magnetic attraction part 21111 and spaced apart from it. By way of another example, the second magnetic attraction part 21112 is located below the first magnetic attraction part 21111. It should be understood that the shape of the first magnetic attraction element 2111 may also be other shapes, such as circular, irregular, etc.

In one embodiment of the present application, as shown in FIG. 2, the second magnetic attraction element 2121 is strip-shaped and has an integral structure. In another embodiment of the present application, the second magnetic attraction element 2121 comprises a plurality of magnetic attraction parts, such as a fifth magnetic attraction part 21211, a sixth magnetic attraction part 21212, a seventh magnetic attraction part 21213, an eighth magnetic attraction part, etc. The distribution of the respective magnetic attraction parts may be set according to actual requirements. For example, as shown in FIG. 13, the sixth magnetic attraction part 21212 is located to the left of the fifth magnetic attraction part 21211 and spaced apart from it; the seventh magnetic attraction part 21213 is located to the right of the fifth magnetic attraction part 21211 and spaced apart from it. By way of another example, the sixth magnetic attraction part 21212 is located below the fifth magnetic attraction part 21211. It should be understood that the shape of the second magnetic attraction element 2121 may also be other shapes, such as circular, irregular, etc.

The first mating element 212 is disposed on the first corresponding portion 111 or the second folding portion 122.

Accordingly, in one embodiment of the present application, the first mating element 212 is disposed on the first corresponding portion 111, so that when the first folding portion 121 is folded downward to face the first corresponding portion 111, the first fastening element 211 is coupled with the first mating element 212 to close the opening 1101. Accordingly, the second magnetic attraction element 2121 is disposed on the first corresponding portion 111, so that when the first folding portion 121 is folded downward to face the first corresponding portion 111, the first magnetic attraction element 2111 and the second magnetic attraction element 2121 attract each other to close the opening 1101.

Further, in some embodiments of the present application, the first corresponding portion 111 comprises a first front main structural layer 1111 and a first front covering layer 1112. The first front covering layer 1112 is connected to the first front main structural layer 1111 and covers a rear side of the first mating element 212. In one example of the present application, the first front main structural layer 1111 and the first front covering layer 1112 are connected to form a closed space, within which the first mating element 212 is installed. This configuration enables the first mating element 212 to be held in the first corresponding portion 111 even without being connected thereto via adhesive or other connecting elements, and also allows the first mating element 212 to be "hidden" inside the first corresponding portion 111 so as not to be visible, thereby making the overall appearance of the waterproof bag neat and aesthetically pleasing. It should be understood that in other examples of the present application, the first corresponding portion 111 may not include the first front covering layer 1112.

In another embodiment of the present application, the first mating element 212 is disposed on the second folding portion 122, so that when the first folding portion 121 is folded downward to face the first corresponding portion 111, the first fastening element 211 is coupled with the first mating element 212 to close the opening 1101, wherein the first corresponding portion 111 faces the second folding portion 122. Accordingly, the second magnetic attraction element 2121 is disposed on the second folding portion 122, so that when the first folding portion 121 is folded downward to face the first corresponding portion 111, the first magnetic attraction element 2111 and the second magnetic attraction element 2121 attract each other to close the opening 1101.

It is worth mentioning that, in the embodiments of the present application, as shown in FIGS. 2 to 12, the first folding portion 121 is not only provided with the first fastening element 211, but also with the second fastening element 221.

Specifically, the first folding portion 121 comprises a first rear main structural layer 1211. When the waterproof bag is in the second folded state S3, the rear side of the first rear main structural layer 1211 faces the outer surface of the second corresponding portion 112.

It is worth mentioning that when the second fastening structure pair 22 achieves fastening through VELCRO, the first fastening element 211 is disposed on the front side of the first rear main structural layer 1211; the second fastening element 221 is disposed and exposed on the rear side of the first rear main structural layer 1211. In this way, two fastening elements are arranged at the first folding portion 121.

In one embodiment of the present application, the first folding portion 121 further comprises a first rear covering layer 1212. The first rear covering layer 1212 is connected to the first rear main structural layer 1211 and covers the front side of the first fastening element 211. In one example of the present application, the first rear main structural layer 1211 and the first rear covering layer 1212 are connected to form a closed space, within which the first fastening element 211 is installed. This configuration enables the first fastening element 211 to be held in the first folding portion 121 even without being connected thereto via adhesive or other connecting elements, and also allows the first fastening element 211 to be "hidden" inside the first folding portion 121 so as not to be visible, thereby making the overall appearance of the waterproof bag neat and aesthetically pleasing.

The second folding portion 122 comprises a second rear main structural layer 1221. The second rear main structural layer 1221 is located below the first rear main structural layer 1211. When the first mating element 212 is disposed on the second folding portion 122, it is disposed on the front or rear side of the second folding portion 122.

Accordingly, in one embodiment of the present application, as shown in FIGS. 7 to 10, the first mating element 212 is disposed on the front side of the second rear main structural layer 1221, positioned between the second rear main structural layer 1221 and the first corresponding portion 111. In this embodiment, the second folding portion 122 further comprises a second rear covering layer 1222; the second rear covering layer 1222 is connected to the second rear main structural layer 1221 and covers the front side of the first mating element 212.

Figure 11:
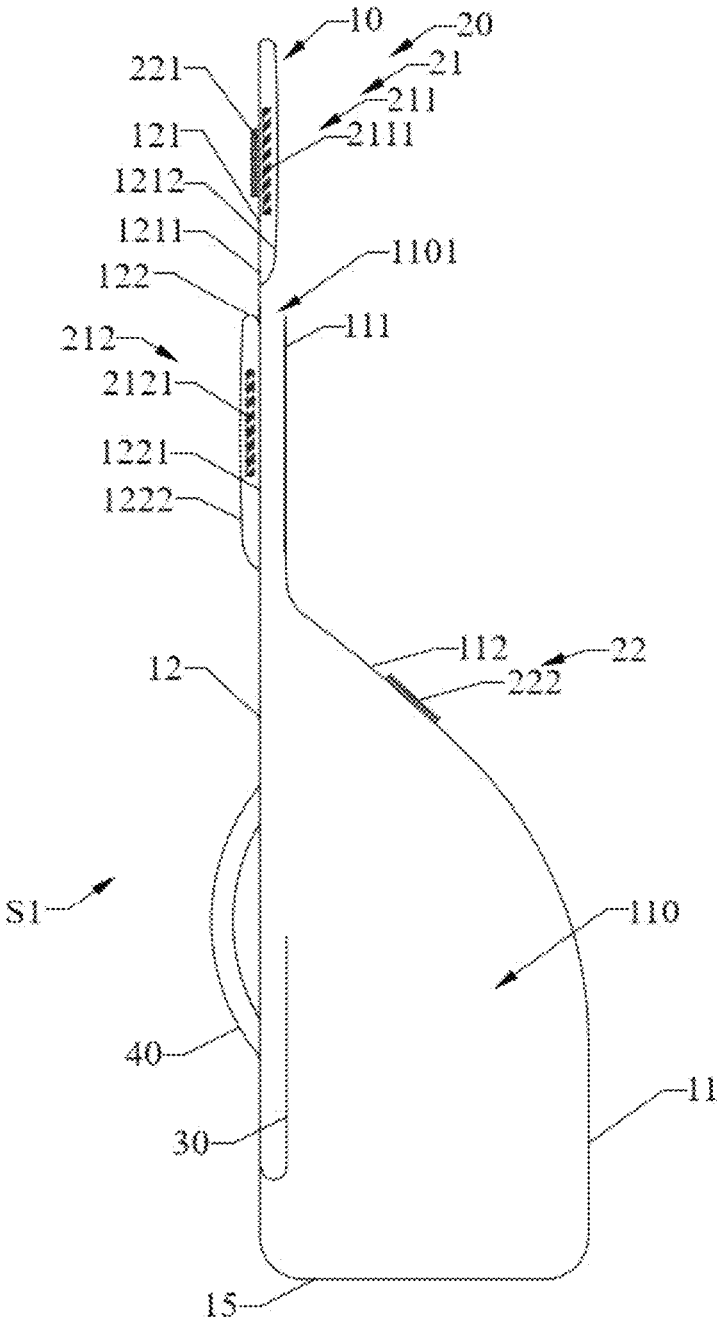
FIG. 11 is a cross-sectional view of the waterproof bag according to a third embodiment of the present application in an unfolded state.
Figure 12:
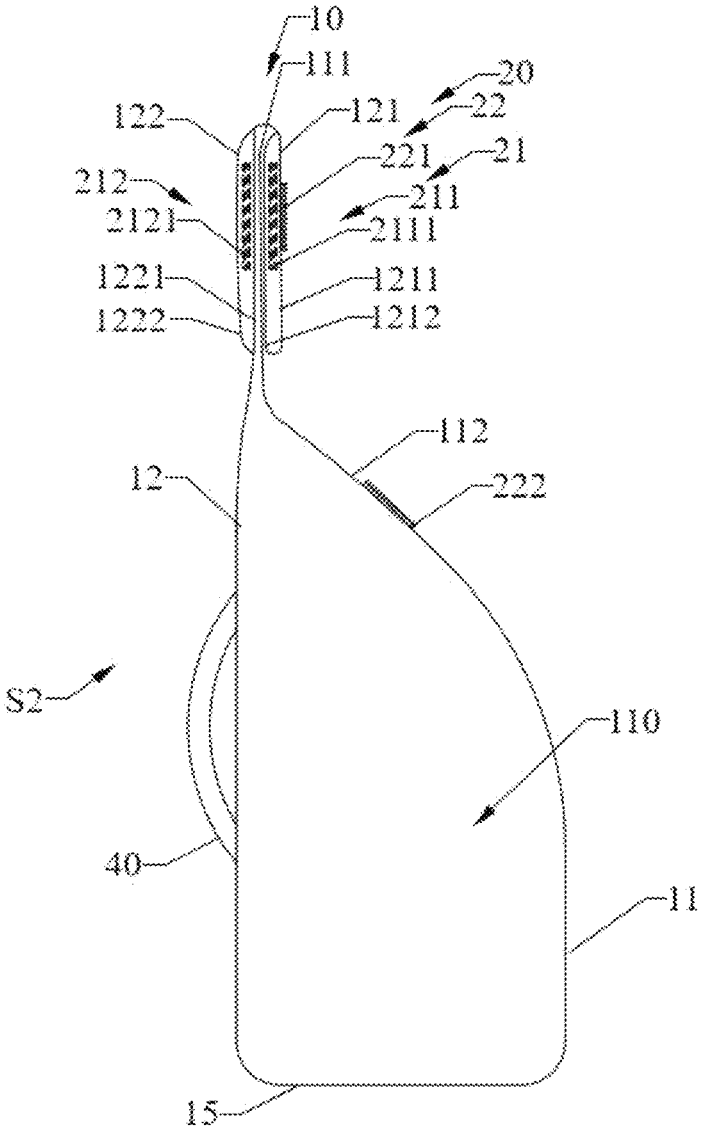
FIG. 12 is a cross-sectional view of the waterproof bag according to the third embodiment of the present application in a first folded state.

In another embodiment of the present application, the first mating element 212 is disposed on the rear side of the second rear main structural layer 1221, as shown in FIGS. 11 and 12. In this embodiment, the second rear covering layer 1222 covers the rear side of the first mating element 212.

In one example of the present application, the second rear main structural layer 1221 and the second rear covering layer 1222 are connected to form a closed space, within which the first mating element 212 is installed. This configuration enables the first mating element 212 to be held in the second folding portion 122 even without being connected thereto via adhesive or other connecting elements, and also allows the first mating element 212 to be "hidden" inside the second folding portion 122 so as not to be visible, thereby making the overall appearance of the waterproof bag neat and aesthetically pleasing. It should be understood that the second rear covering layer 1222 may also be omitted.

It is worth mentioning that if the first mating element 212 is disposed on the rear side of the second rear main structural layer 1221, when the first folding portion 121 is folded downward to face the first corresponding portion 111, there is no first mating element 212 between the first folding portion 121 and the second rear main structural layer 1221 of the second folding portion 122, making the structure therebetween relatively thin. As a result, when the first folding portion 121, the first corresponding portion 111 and the second folding portion 122 are further folded downward to face the second front corresponding portion 112, the second fastening element 221 and the second mating element 222 can fit more closely.

Figure 3:
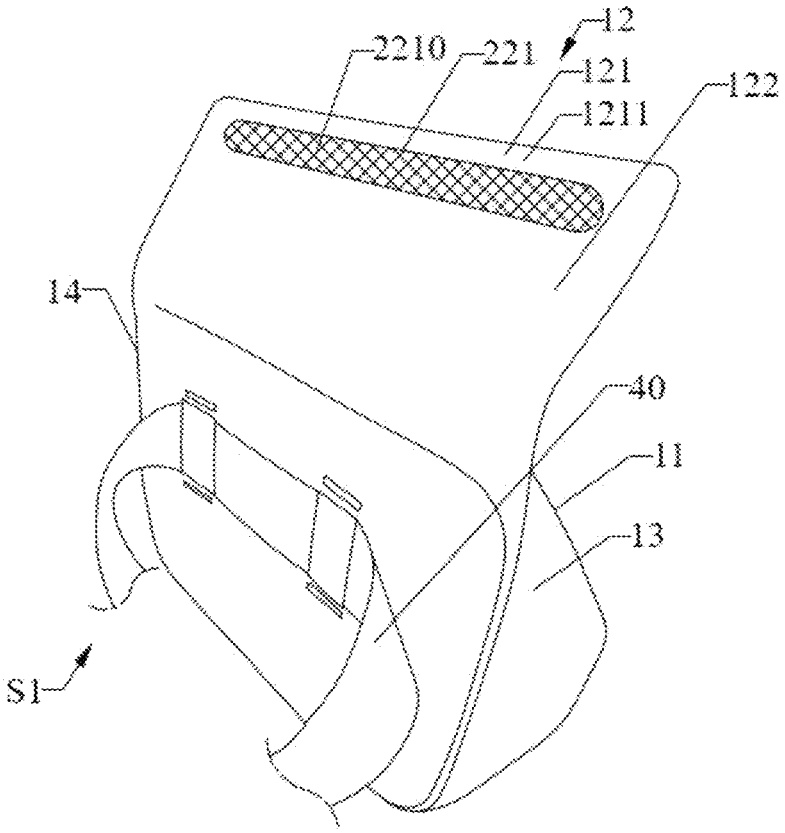
FIG. 3 is another perspective view of the waterproof bag according to the first embodiment of the present application in an unfolded state.

As shown in FIGS. 2 and 3, when the second fastening structure pair 22 achieves fastening through VELCRO, the second fastening element 221 is disposed and exposed on the rear side of the first rear main structural layer 1211; the second mating element 222 is disposed and exposed on the outer surface of the second corresponding portion 112; so that when the waterproof bag is in the second folded state S3, the hooks 2210 of the second fastening element 221 are fastened to the loops 2220 of the second mating element 222, or the loops 2220 of the second fastening element 221 are fastened to the hooks 2210 of the second mating element 222.

Figure 14:
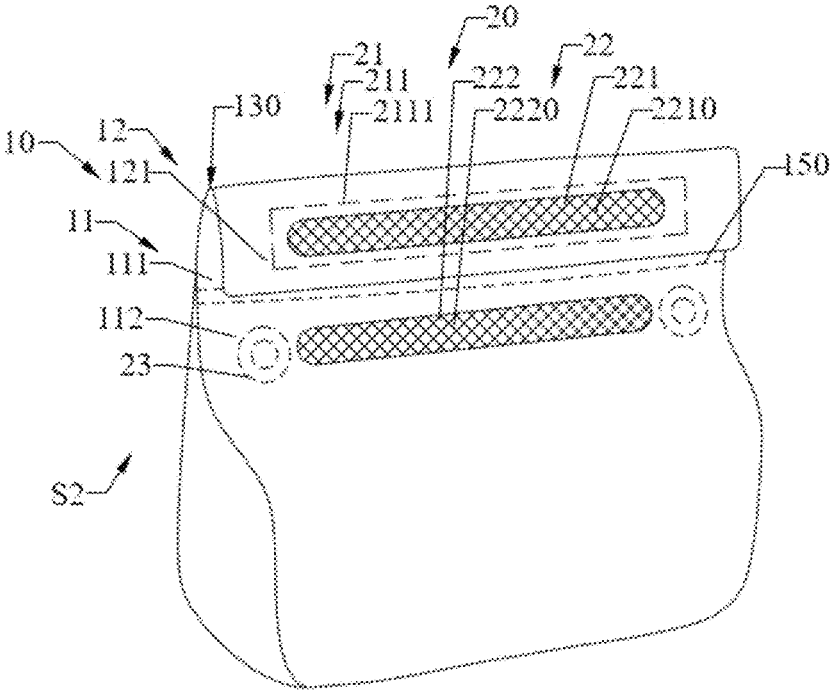
FIG. 14 is a perspective view of the waterproof bag according to a fifth embodiment of the present application in a first folded state.
Figure 15:
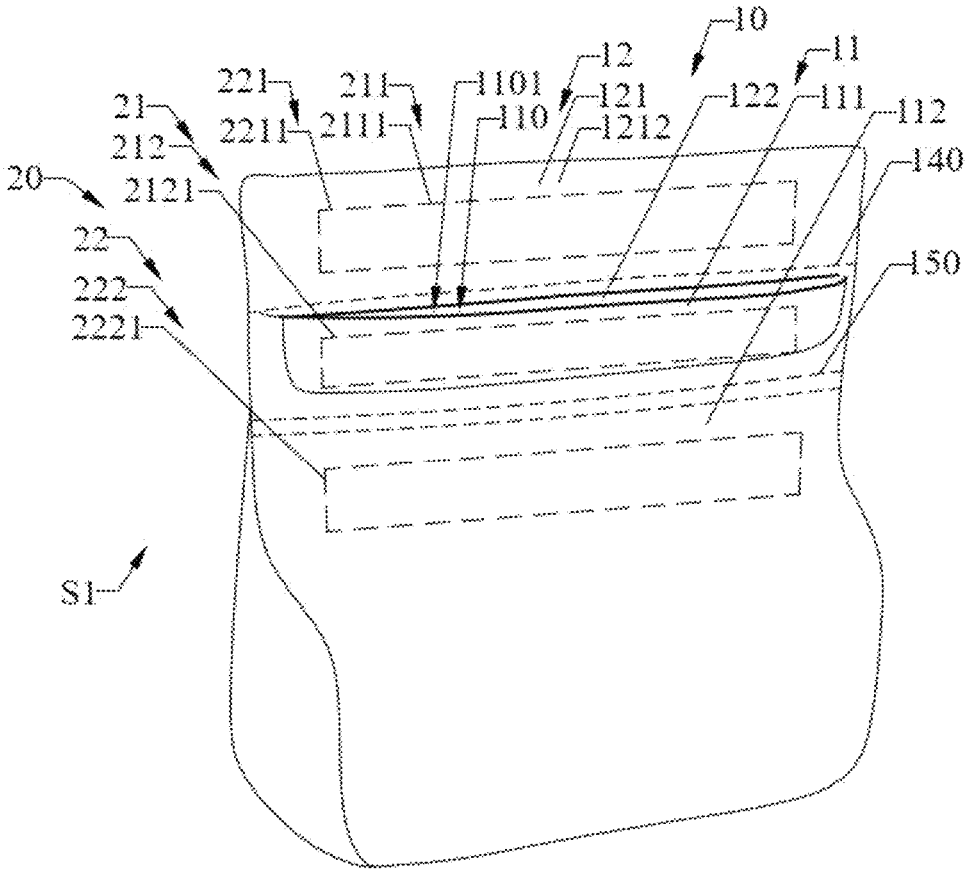
FIG. 15 is a perspective view of the waterproof bag according to a sixth embodiment of the present application in an unfolded state.

It is worth mentioning that, in order to make the first folding portion 121 and the second corresponding portion 112 fit more closely after the second folding portion 122 is folded, when the second fastening structure pair 22 achieves fastening through VELCRO, in one embodiment of the present application, the waterproof bag further comprises at least one auxiliary magnetic attraction element 23 (as shown in FIG. 14). The auxiliary magnetic attraction element 23 is disposed on the second corresponding portion 112, and when the main body portion 10 is in the second folded state S3, the first magnetic attraction element 2111 and the auxiliary magnetic attraction element 23 attract each other.

In particular, when the second fastening structure pair 22 achieves fastening through a magnetic attraction structure, the first magnetic attraction element 2111 and the third magnetic attraction element 2211 may be different magnetic attraction elements or may be the same magnetic attraction element. When the first magnetic attraction element 2111 and the third magnetic attraction element 2211 can be the same magnetic attraction element, the first magnetic attraction element 2111 is used not only as part of the first fastening element 211 but also as part of the second fastening element 221, as shown in FIGS. 15 to 20. In other words, the first magnetic attraction element 2111 may serve as a shared magnetic attraction element for both the first fastening element 211 and the second fastening element 221.

It is worth mentioning that when the second fastening structure pair 22 achieves fastening through a magnetic attraction structure, the second mating element 222 is disposed on the second corresponding portion 112 and/or on the part of the rear side portion 12 opposite to the second corresponding portion 112 (i.e., the spare rear covering layer 1242 described hereinafter), as shown in FIGS. 15 to 20.

The second corresponding portion 112 comprises a second front main structural layer 1121. When the second mating element 222 is disposed on the second corresponding portion 112, it is disposed on the front or rear side of the second front main structural layer 1121.

Figure 16:
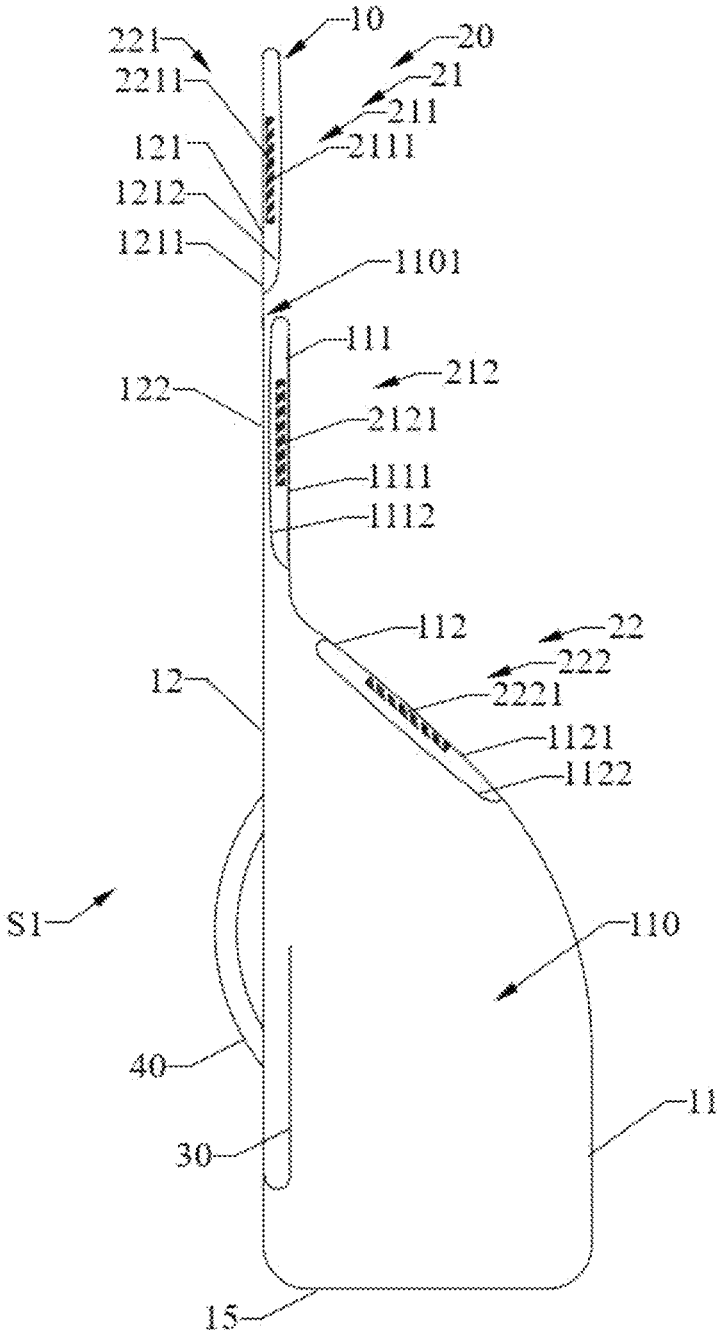
FIG. 16 is a cross-sectional view of the waterproof bag according to the sixth embodiment of the present application in an unfolded state.
Figure 17:
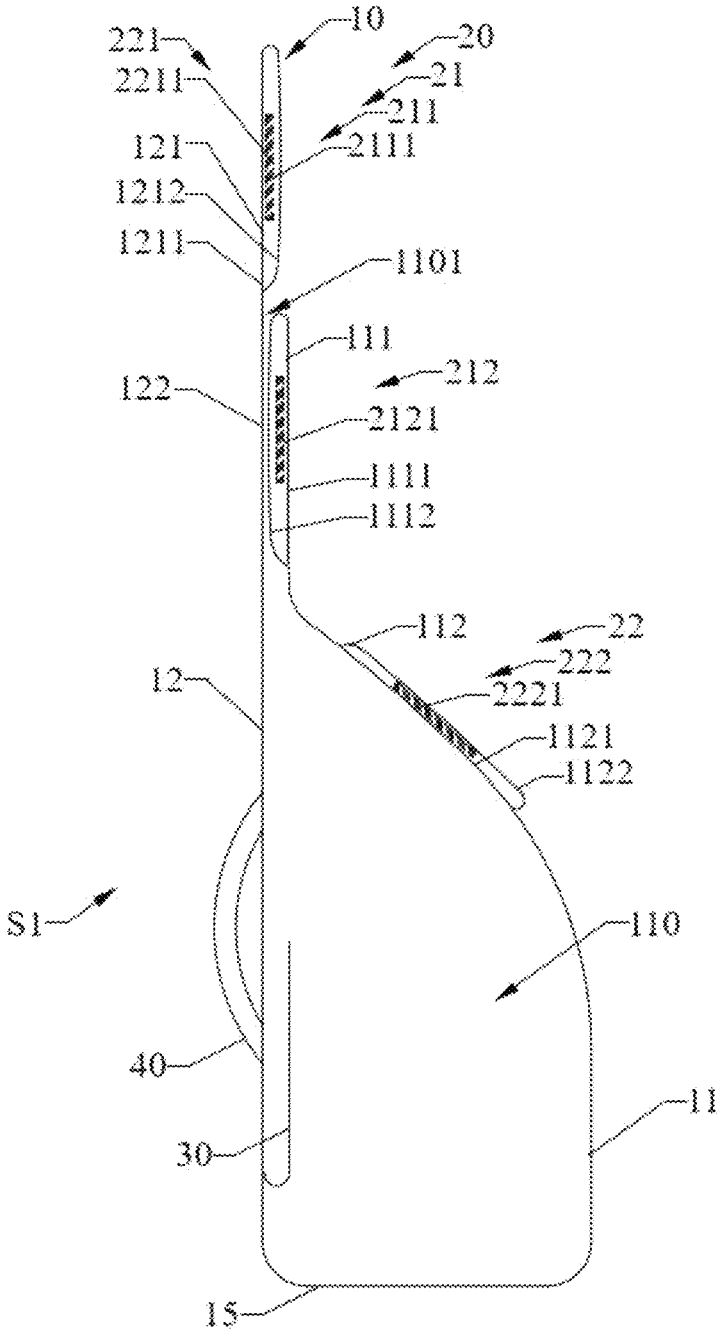
FIG. 17 is a cross-sectional view of the waterproof bag according to a seventh embodiment of the present application in an unfolded state.

In some embodiments of the present application, as shown in FIGS. 16 and 17, the second corresponding portion 112 further comprises a second front covering layer 1122. The second front covering layer 1122 is connected to the second front main structural layer 1121. When the second mating element 222 is disposed on the front side of the second front main structural layer 1121, as shown in FIG. 17, the second front covering layer 1122 covers the front side of the second mating element 222. When the second mating element 222 is disposed on the rear side of the second front main structural layer 1121, as shown in FIG. 16, the second front covering layer 1122 covers the rear side of the second mating element 222.

In one example of the present application, the second front main structural layer 1121 and the second front covering layer 1122 are connected to form a closed space, within which the second mating element 222 is installed. This configuration enables the second mating element 222 to be held in the second corresponding portion 112 even without being connected thereto via adhesive or other connecting elements, and also allows the second mating element 222 to be "hidden" inside the second corresponding portion 112 so as not to be visible, thereby making the overall appearance of the waterproof bag neat and aesthetically pleasing. It should be understood that, in other examples of the present application, the second corresponding portion 112 may also omit the second front covering layer 1122.

Figure 18:
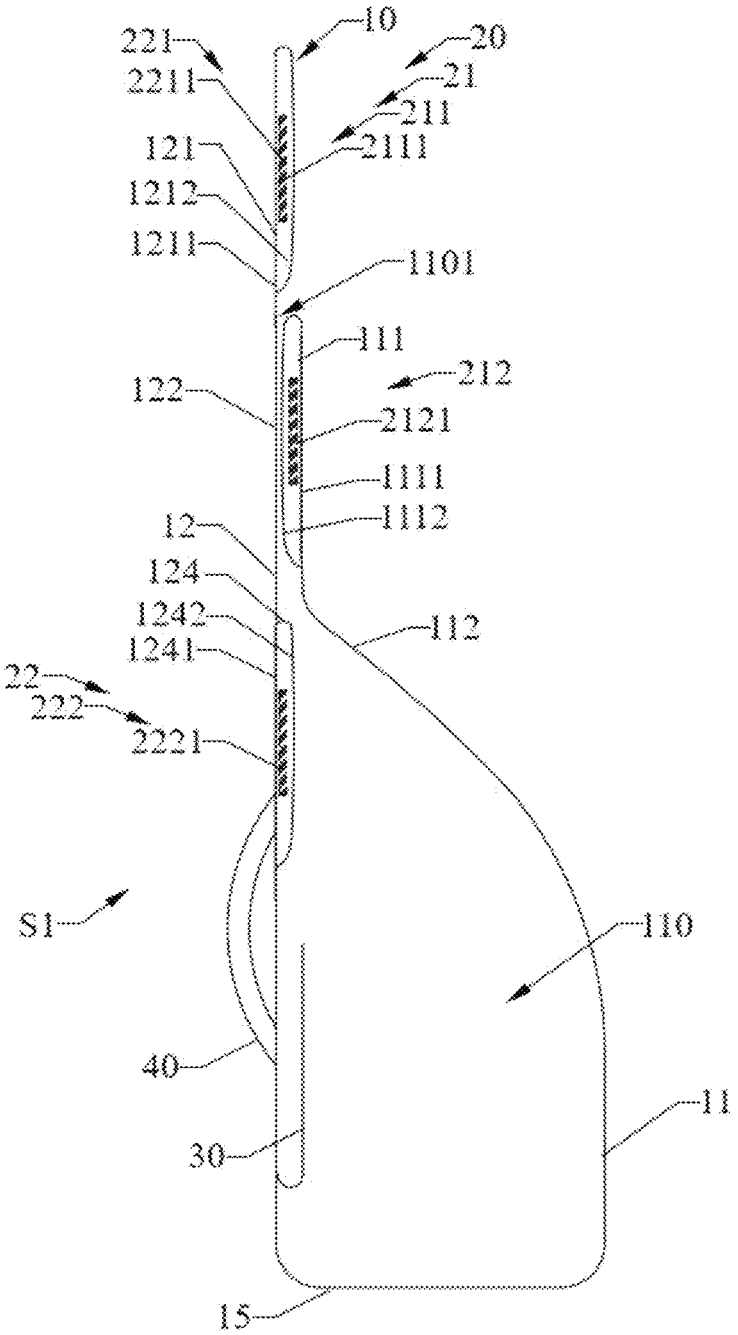
FIG. 18 is a cross-sectional view of the waterproof bag according to an eighth embodiment of the present application in an unfolded state.
Figure 19:
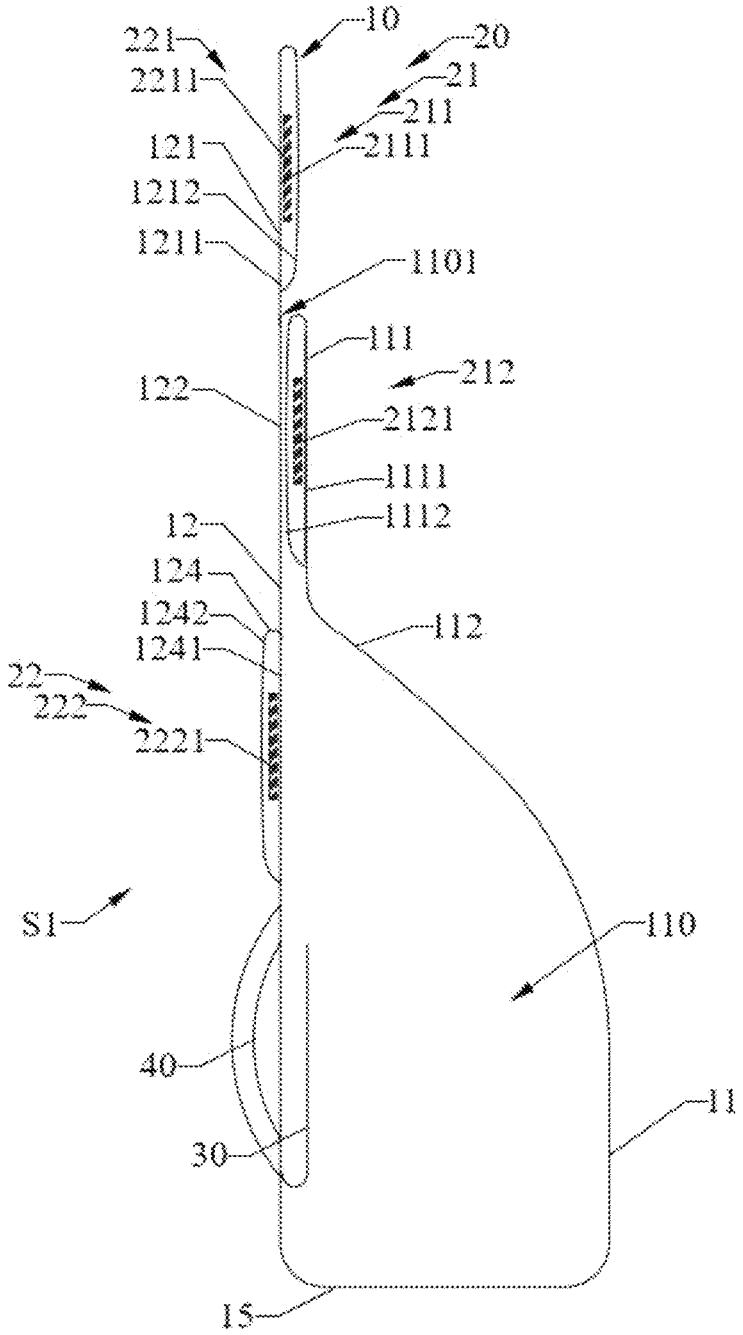
FIG. 19 is a cross-sectional view of the waterproof bag according to a ninth embodiment of the present application in an unfolded state.

In some embodiments of the present application, as shown in FIGS. 18 and 19, the rear side portion 12 further comprises a rear spare installation portion 124. The rear spare installation portion 124 is located below the second folding portion 122 and faces the second corresponding portion 112 in the front-rear direction.

When the second fastening structure pair 22 is mainly implemented through a magnetic attraction structure, the second mating element 222 may be mounted on the rear spare installation portion 124. The rear spare installation portion 124 comprises a spare rear main structural layer 1241. The second mating element 222 is mounted on the front or rear side of the rear spare installation portion 124.

In some embodiments of the present application, as shown in FIGS. 18 and 19, the rear spare installation portion 124 further comprises a spare rear covering layer 1242. The spare rear covering layer 1242 is connected to the spare rear main structural layer 1241.

When the second mating element 222 is disposed on the front side of the spare rear main structural layer 1241, as shown in FIG. 18, the spare rear covering layer 1242 covers the front side of the second mating element 222. When the second mating element 222 is disposed on the rear side of the spare rear main structural layer 1241, as shown in FIG. 19, the spare rear covering layer 1242 covers the rear side of the second mating element 222.

In one example of the present application, the second front main structural layer 1121 and the second front covering layer 1122 are connected to form a closed space, within which the second mating element 222 is installed. This configuration enables the second mating element 222 to be held in the second corresponding portion 112 even without being connected thereto via adhesive or other connecting elements, and also allows the second mating element 222 to be "hidden" inside the second corresponding portion 112 so as not to be visible, thereby making the overall appearance of the waterproof bag neat and aesthetically pleasing. It should be understood that, in other examples of the present application, the rear spare installation portion 124 may also omit the spare rear covering layer 1242.

Figure 20:
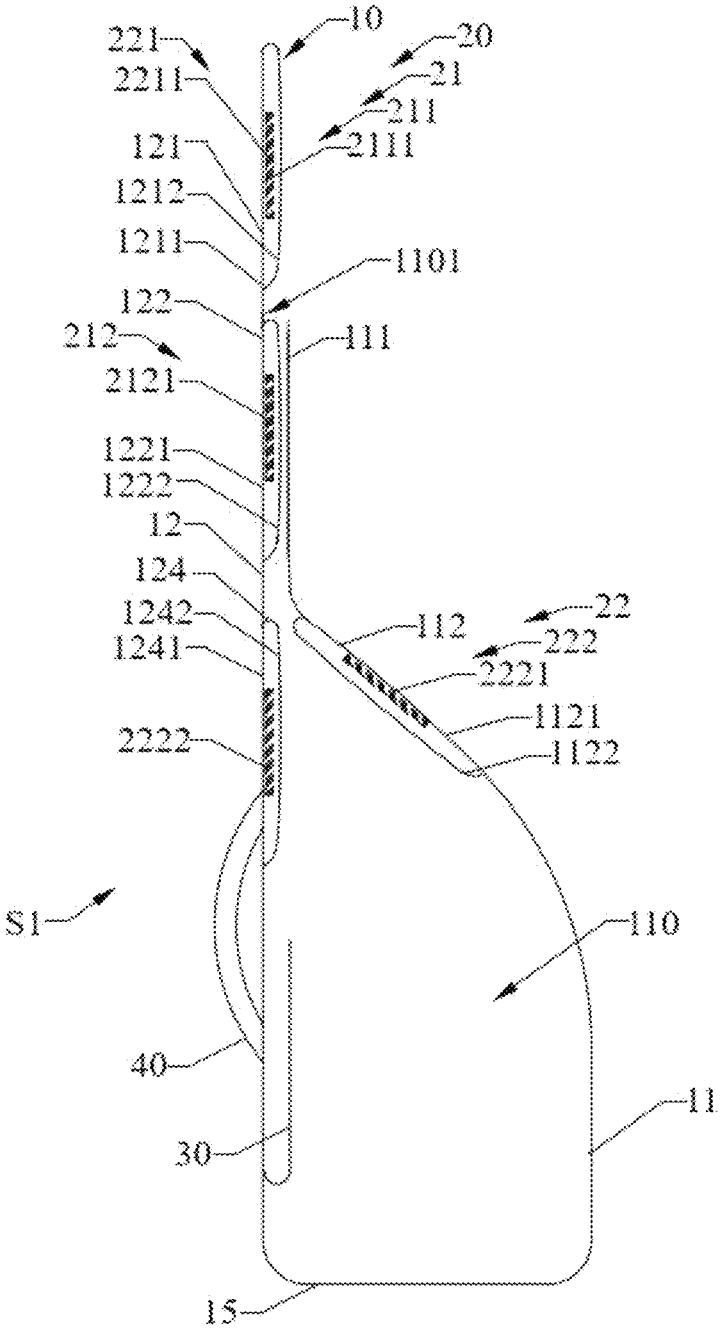
FIG. 20 is a perspective view of the waterproof bag according to a tenth embodiment of the present application in an unfolded state.

In one example of the present application, the first fastening element 211 comprises a first magnetic attraction element 2111; the first mating element 212 comprises a second magnetic attraction element 2121; when the main body portion 10 is in the first folded state S2, the first magnetic attraction element 2111 and the second magnetic attraction element 2121 attract each other, thereby closing the opening 1101. The second fastening element 221 comprises a third magnetic attraction element 2211; the second mating element 222 comprises a fourth magnetic attraction element 2221; when the main body portion 10 is in the second folded state S3, the third magnetic attraction element 2211 and the fourth magnetic attraction element 2221 attract each other, thereby achieving fastening therebetween; wherein the first magnetic attraction element 2111 and the third magnetic attraction element 2211 are the same magnetic attraction element. As shown in FIG. 20, the second mating element 222 further comprises a fifth magnetic attraction element 2222, wherein the fourth magnetic attraction element 2221 is mounted on the second corresponding portion 112, and the fifth magnetic attraction element 2222 is mounted on the rear spare installation portion 124.

It is worth mentioning that, in order to make the first folding portion 121 fit more closely with the first corresponding portion 111 after being folded, in one embodiment of the present application, the waterproof bag is provided with a first preset crease 140. The first preset crease 140 is disposed between the first folding portion 121 and the second folding portion 122, and the thickness of the first preset crease 140 is less than the thickness of the first folding portion 121.

To make the first folding portion 121 fit more closely with the second corresponding portion 112 after the second folding portion 122 is folded, in one embodiment of the present application, the waterproof bag is provided with a second preset crease 150. The second preset crease 150 is disposed between the first corresponding portion 111 and the second corresponding portion 112, and the thickness of the second preset crease 150 is less than the thickness of the first corresponding portion 111.

Also worth noting is that, in order to allow the front side portion 11 and the rear side portion 12 to fit more tightly together after the first folding portion 121 and/or the second folding portion 122 is folded, at least one air column bag 190 is provided between the front side portion 11 and the rear side portion 12 according to the present application. At least one of the air column bags 190 is disposed at the first bend portion 120 and/or the second bend portion 130. The air column bag 190 extends in the left-right direction. Preferably, a single air column bag 190 continuously extends between the left edge and the right edge of the main body portion 10. Alternatively, a plurality of air column bags 190 may extend between the left edge and the right edge of the main body portion 10 in a spaced manner.

Figure 21:
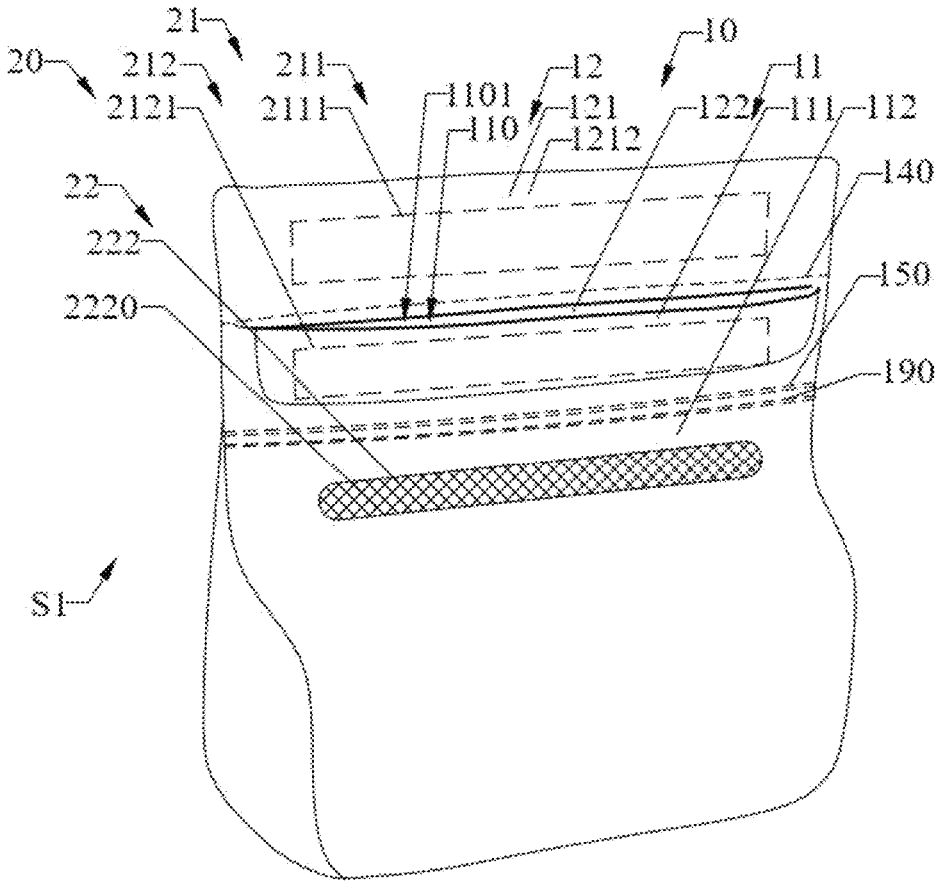
FIG. 21 is a cross-sectional view of the waterproof bag according to an eleventh embodiment of the present application in an unfolded state.
Figure 22:
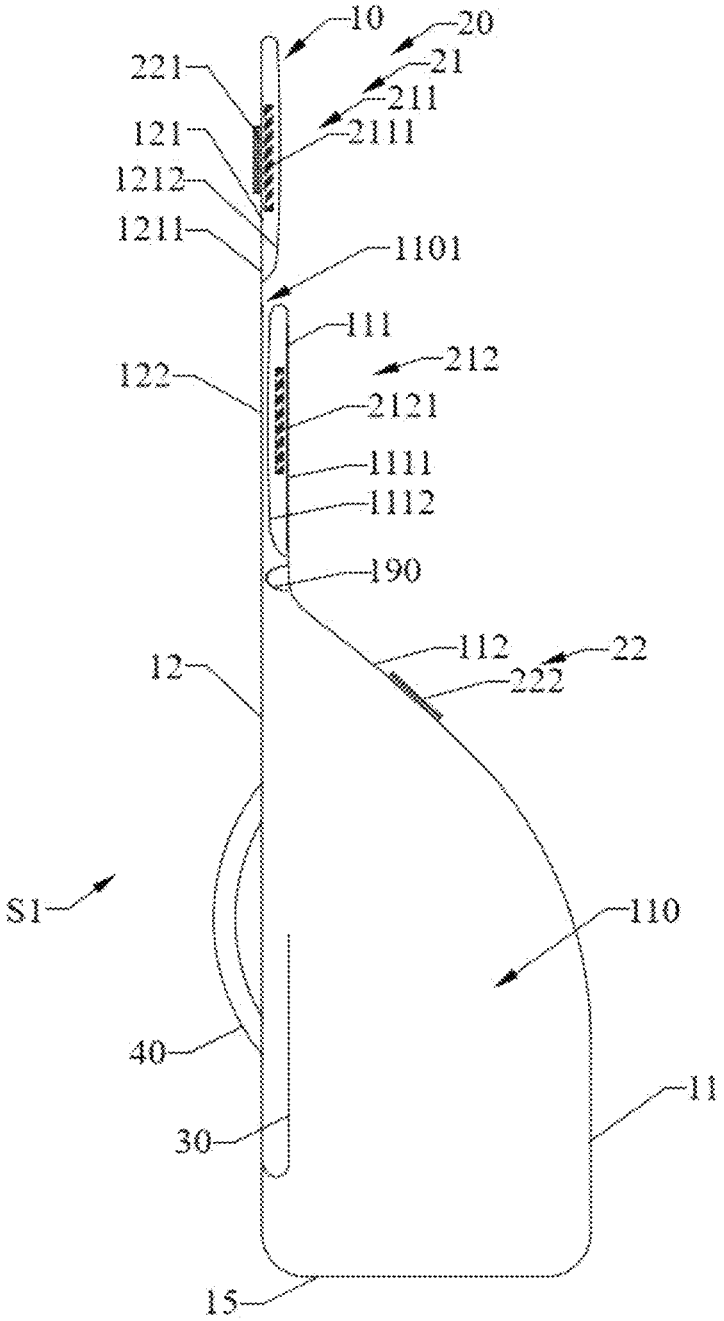
FIG. 22 is another cross-sectional view of the waterproof bag according to the eleventh embodiment of the present application in an unfolded state.

Accordingly, in one embodiment of the present application, as shown in FIGS. 21 and 22, at least one of the air column bags 190 is disposed between the first corresponding portion 111 and the second corresponding portion 112, and is located on the rear side of the front side portion 11, facing toward the rear side portion 12, such that after the second folding portion 122 is folded, the air column bag 190 fits tightly against the rear side portion 12, thereby preventing liquid from entering the accommodating cavity 110 of the main body portion 10 through a gap between the lower edge of the first corresponding portion 111 and the rear side portion 12.

Figure 23:
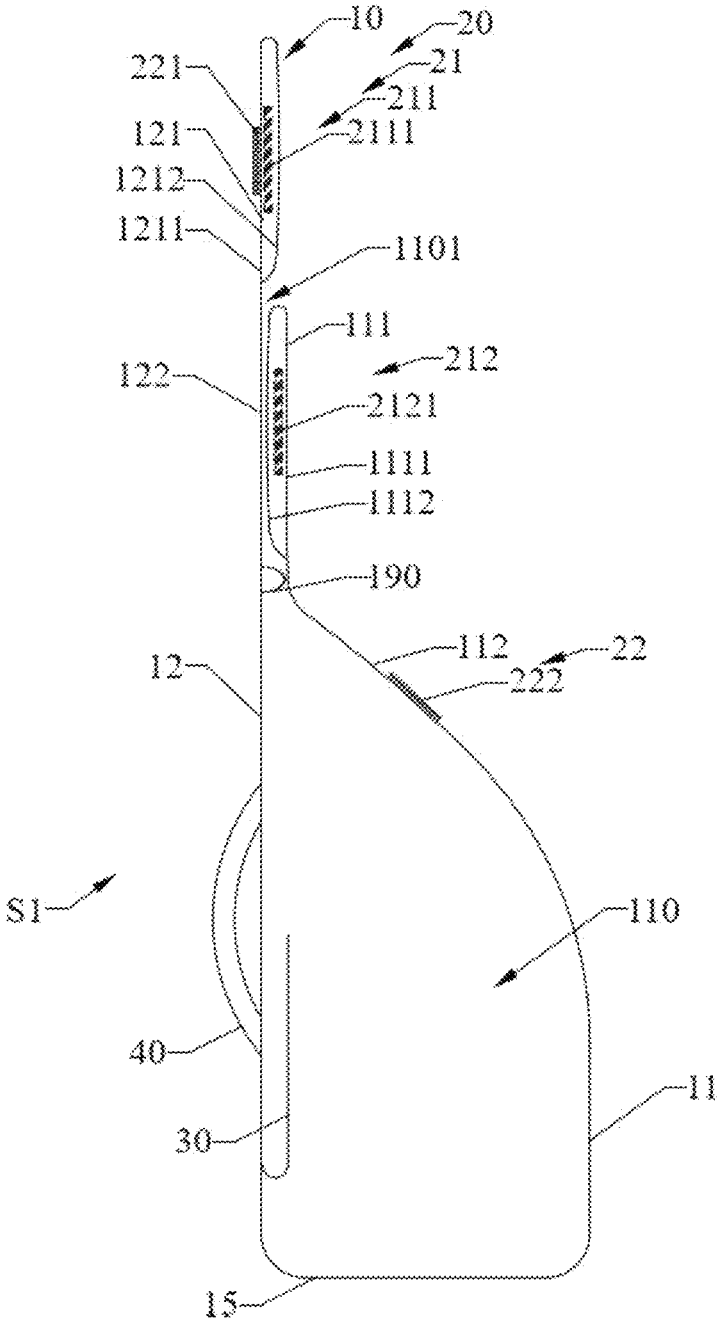
FIG. 23 is a cross-sectional view of the waterproof bag according to a twelfth embodiment of the present application in an unfolded state.

In another embodiment of the present application, as shown in FIG. 23, at least one of the air column bags 190 is disposed below the second folding portion 122 and corresponds to a portion between the first corresponding portion 111 and the second corresponding portion 112 of the front side portion 11. The air column bag 190 is located on the front side of the rear side portion 12, facing toward the front side portion 11, such that after the second folding portion 122 is folded, the air column bag 190 fits tightly against the front side portion 11, thereby preventing liquid from entering the accommodating cavity 110 of the main body portion 10 through a gap between the lower edge of the first corresponding portion 111 and the rear side portion 12.

Figure 24:
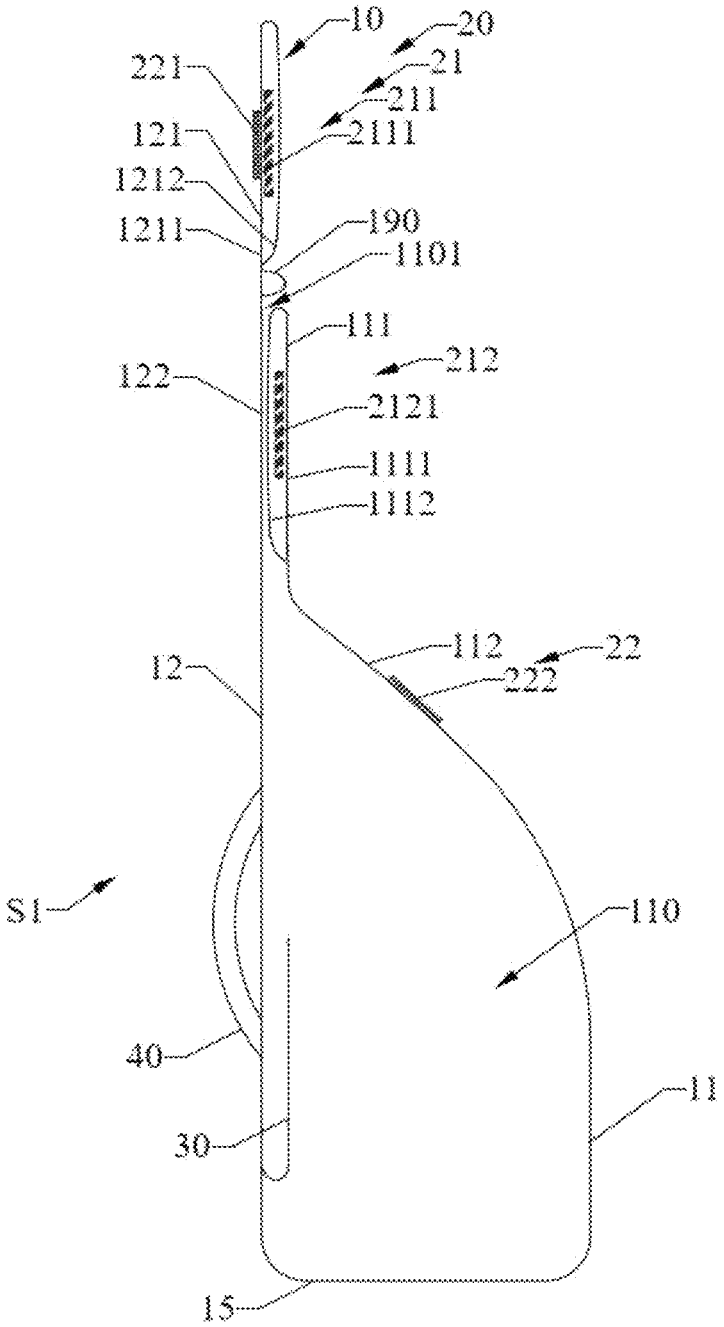
FIG. 24 is a cross-sectional view of the waterproof bag according to a thirteenth embodiment of the present application in an unfolded state.

In another example of the present application, as shown in FIG. 24, at least one of the air column bags 190 is disposed between the first folding portion 121 and the second folding portion 122, and adjacent to the opening 1101, such that after the first folding portion 121 is folded, the air column bag 190 is filled at the opening 1101 and fits tightly against the front side portion 11, thereby preventing liquid from entering the accommodating cavity 110 of the main body portion 10 through the opening 1101.

It is worth mentioning that it should be understood that, in embodiments of the present application, the rear side portion 12 may be folded more than twice, for example, three or four times. The waterproof bag may be provided with additional fastening structure pairs, such as a third fastening structure pair, a fourth fastening structure pair.

In one embodiment of the present application, the rear side portion 12 may be folded three times, and the rear side portion 12 further comprises a third folding portion; the front side portion 11 comprises a third corresponding portion. The third folding portion is located between the first folding portion 121 and the second folding portion 122. The third corresponding portion is located between the first corresponding portion 111 and the second folding portion 122. The fastening assembly 20 comprises the third fastening structure pair. The third fastening structure pair comprises a third fastening element and a third mating element. The third fastening element is disposed on the third folding portion; the third mating element is disposed on the third corresponding portion.

It is worth mentioning that in the embodiments illustrated in FIGS. 1 to 24 of the present application, the waterproof bag achieves dual fastening through two foldings, namely, fastening between the first fastening element 211 and the first mating element 212, and fastening between the second fastening element 221 and the second mating element 222. In other embodiments of the present application, the waterproof bag may also achieve single fastening, dual fastening, or multiple fastening through a single folding.

Accordingly, in the embodiments illustrated in FIGS. 25 to 32 of the present application, the front side portion 11 and the rear side portion 12 are configured to be foldable at least once, so as to allow the waterproof bag to switch between an unfolded state S1 and a first folded state S2.

Specifically, the rear side portion 12 is flush with the front side portion 11 in the height direction of the main body portion 10. The rear side portion 12 comprises a first folding portion 121 and a rear installation portion 123. The rear installation portion 123 is located between the first folding portion 121 and the second folding portion 122. The front side portion 11 comprises a first corresponding portion 111 and a front installation portion 113. The front installation portion 113 is located below the first corresponding portion 111. The first corresponding portion 111 faces the first folding portion 121; the front installation portion 113 faces the rear installation portion 123. The fastening assembly 20 comprises a first fastening element 211 and a first mating element 212. The first fastening element 211 is disposed on the first folding portion 121; the first mating element 212 is disposed on the main body portion 10 and is adapted to be coupled with the first fastening element 211 when the waterproof bag is in the unfolded state S1 and/or the first folded state S2.

In some embodiments of the present application, the fastening assembly 20 further comprises a second fastening element 221 and a second mating element 222. The second fastening element 221 is disposed on the rear installation portion 123; the second mating element 222 is disposed on the main body portion 10 and is adapted to be coupled with the second fastening element 221 when the waterproof bag is in the unfolded state S1 and/or the first folded state S2.

Specifically, in one embodiment of the present application, the first fastening element 211 is disposed on the first folding portion 121; the second fastening element 221 is disposed on the rear installation portion 123; the first mating element 212 is disposed on the first corresponding portion 111; the second mating element 222 is disposed on the front installation portion 113.

Figure 25:
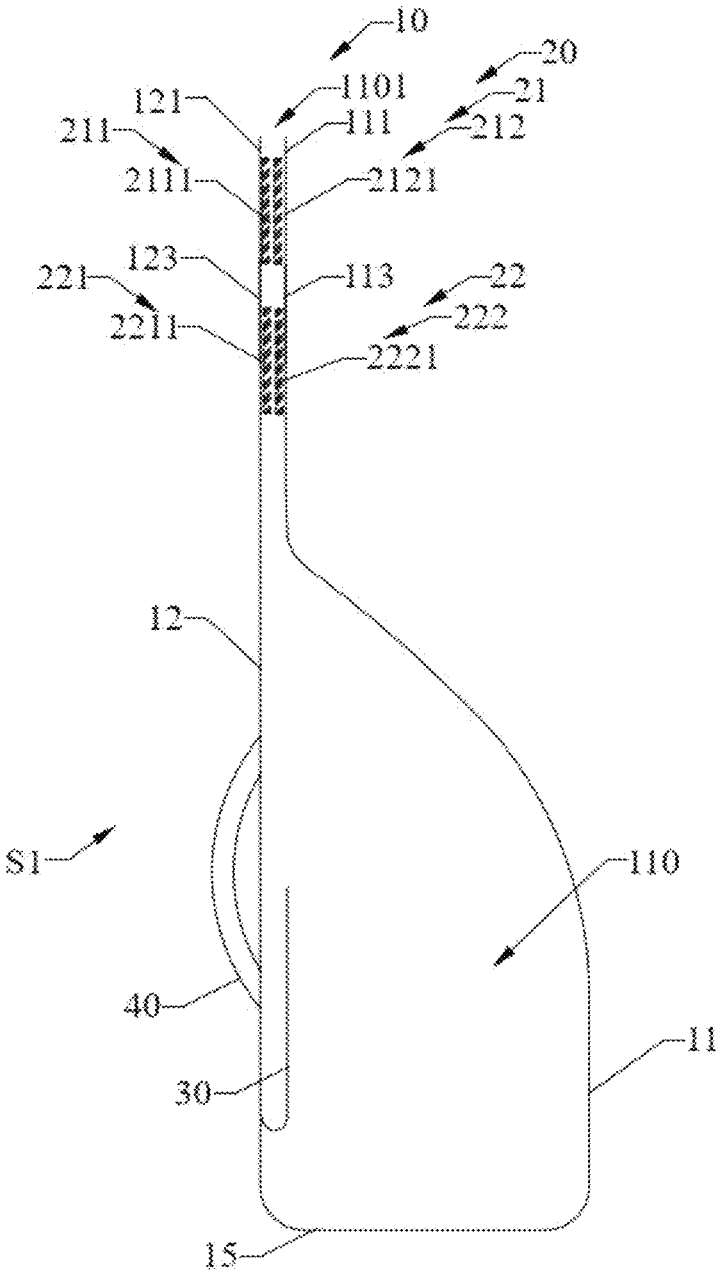
FIG. 25 is a cross-sectional view of the waterproof bag according to a fourteenth embodiment of the present application in a first folded state.

As shown in FIG. 25, when the waterproof bag is in the unfolded state S1, the first fastening element 211 is aligned and coupled with the first mating element 212; the second fastening element 221 is aligned and coupled with the second mating element 222. Thus, dual fastening can be achieved when the waterproof bag is in the unfolded state S1, namely, fastening between the first fastening element 211 and the first mating element 212, and fastening between the second fastening element 221 and the second mating element 222.

Figure 26:
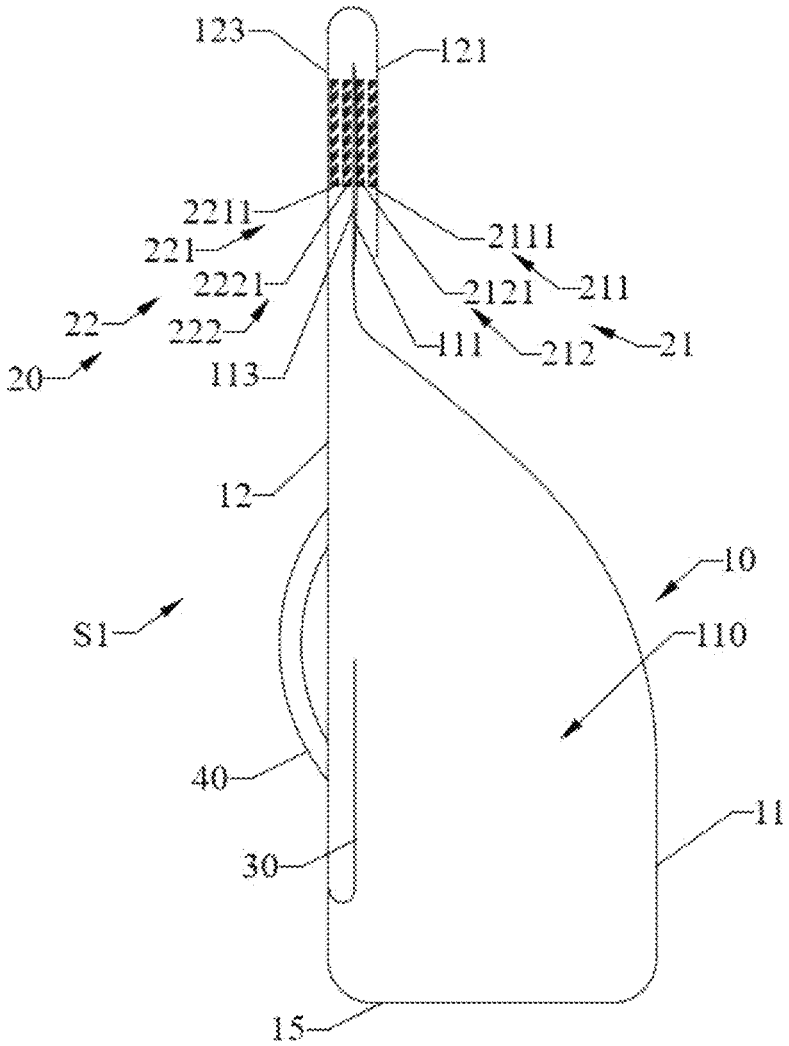
FIG. 26 is a cross-sectional view of the waterproof bag according to the fourteenth embodiment of the present application in an unfolded state.

As shown in FIG. 26, when the waterproof bag is in the first folded state S2, the first folding portion 121 and the first corresponding portion 111 are folded downward to face the front installation portion 113; the first mating element 212 is aligned and coupled with the second mating element 222, thereby achieving a third level of fastening.

In the embodiment illustrated in FIGS. 25 and 26, the waterproof bag mainly achieves fastening through magnetic attraction structures. Accordingly, the first fastening element 211 comprises a first magnetic attraction element 2111; the first mating element 212 comprises a second magnetic attraction element 2121; the second fastening element 221 comprises a third magnetic attraction element 2211; the second mating element 222 comprises a fourth magnetic attraction element 2221.

When the waterproof bag is in the unfolded state S1, the first magnetic attraction element 2111 and the second magnetic attraction element 2121 attract each other, thereby closing the opening 1101; the third magnetic attraction element 2211 and the fourth magnetic attraction element 2221 attract each other.

When the main body portion 10 is in the first folded state S2, the second magnetic attraction element 2121 and the fourth magnetic attraction element 2221 attract each other.

The front surface magnetism of the first magnetic attraction element 2111 is opposite to the rear surface magnetism of the second magnetic attraction element 2121; the front surface magnetism of the third magnetic attraction element 2211 is opposite to the rear surface magnetism of the fourth magnetic attraction element 2221; the front surface magnetism of the second magnetic attraction element 2121 is opposite to the front surface magnetism of the fourth magnetic attraction element 2221.

Accordingly, in one example of the present application, the front surface magnetism of the first magnetic attraction element 2111 is positive, the rear surface magnetism of the second magnetic attraction element 2121 is negative; the front surface magnetism of the second magnetic attraction element 2121 is positive; the front surface magnetism of the third magnetic attraction element 2211 is negative; the rear surface magnetism of the fourth magnetic attraction element 2221 is positive; the front surface magnetism of the fourth magnetic attraction element 2221 is negative.

In another example of the present application, the front surface magnetism of the first magnetic attraction element 2111 is negative, the rear surface magnetism of the second magnetic attraction element 2121 is positive; the front surface magnetism of the second magnetic attraction element 2121 is negative; the front surface magnetism of the third magnetic attraction element 2211 is positive; the rear surface magnetism of the fourth magnetic attraction element 2221 is negative; the front surface magnetism of the fourth magnetic attraction element 2221 is positive.

In an embodiment of the present application, the first fastening element 211 is disposed on the first folding portion 121; the second fastening element 221 is disposed on the rear installation portion 123; the first mating element 212 and the second mating element 222 are disposed on the front installation portion 113.

Figure 27:
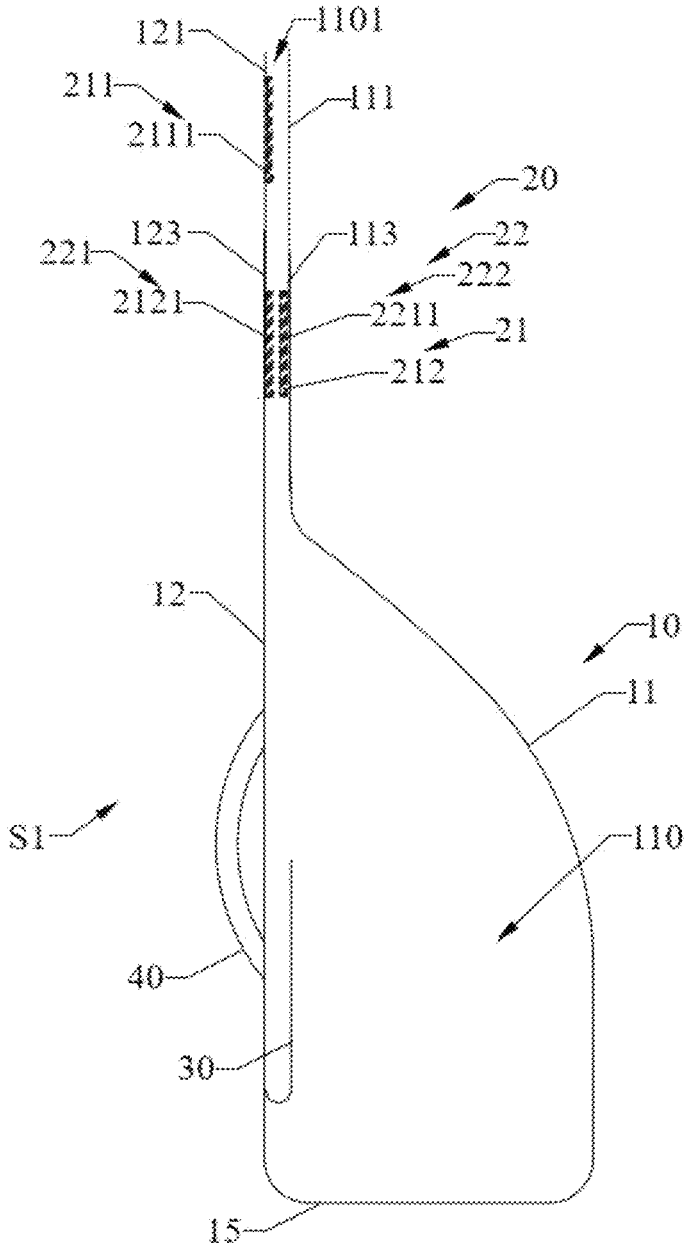
FIG. 27 is a cross-sectional view of the waterproof bag according to a fifteenth embodiment of the present application in a first folded state.

As shown in FIG. 27, when the waterproof bag is in the unfolded state S1, the second fastening element 221 is aligned and coupled with the second mating element 222, thereby achieving fastening between the second fastening element 221 and the second mating element 222.

Figure 28:
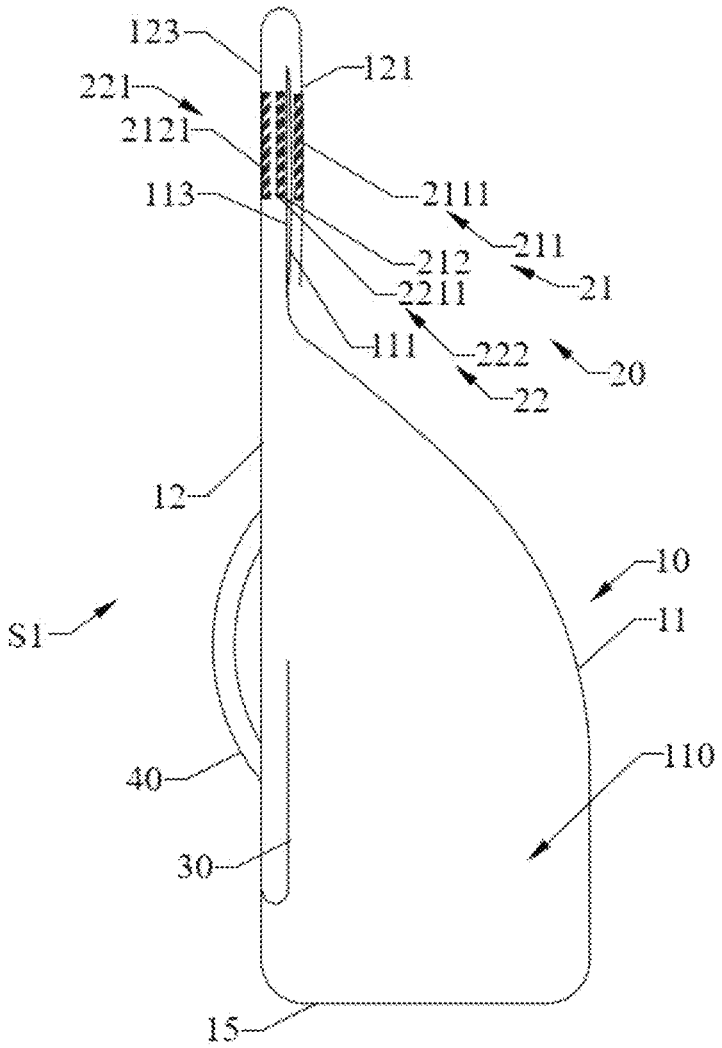
FIG. 28 is a cross-sectional view of the waterproof bag according to the fifteenth embodiment of the present application in an unfolded state.

As shown in FIG. 28, when the waterproof bag is in the first folded state S2, the first folding portion 121 and the first corresponding portion 111 are folded downward to face the front installation portion 113; the first fastening element 211 is aligned and coupled with the first mating element 212, thereby achieving fastening between the first fastening element 211 and the first mating element 212, and thus realizing dual fastening, namely, fastening between the second fastening element 221 and the second mating element 222, and fastening between the first fastening element 211 and the first mating element 212.

In the embodiments illustrated in FIGS. 27 and 28, the waterproof bag mainly achieves fastening through magnetic attraction structures. In this embodiment, the first fastening element 211 comprises a first magnetic attraction element 2111; the second fastening element 221 comprises a second magnetic attraction element 2121; the second mating element 222 comprises a third magnetic attraction element 2211. The third magnetic attraction element 2211 serves as a shared magnet for both the first mating element 212 and the second mating element 222. It should be understood that the first mating element 212 and the second mating element 222 may also not share a common magnet.

When the waterproof bag is in the unfolded state S1, the second magnetic attraction element 2121 and the third magnetic attraction element 2211 attract each other, thereby closing the opening 1101.

When the main body portion 10 is in the first folded state S2, the first magnetic attraction element 2111 and the third magnetic attraction element 2211 attract each other.

The front surface magnetism of the second magnetic attraction element 2121 is opposite to the rear surface magnetism of the third magnetic attraction element 2211; the front surface magnetism of the first magnetic attraction element 2111 is opposite to the front surface magnetism of the third magnetic attraction element 2211.

Accordingly, in one example of the present application, the front surface magnetism of the first magnetic attraction element 2111 is positive; the front surface magnetism of the second magnetic attraction element 2121 is negative; the front surface magnetism of the third magnetic attraction element 2211 is negative; the rear surface magnetism of the third magnetic attraction element 2211 is positive.

In another example of the present application, the front surface magnetism of the first magnetic attraction element 2111 is negative; the front surface magnetism of the second magnetic attraction element 2121 is positive; the front surface magnetism of the third magnetic attraction element 2211 is positive; the rear surface magnetism of the third magnetic attraction element 2211 is negative.

Figure 29:
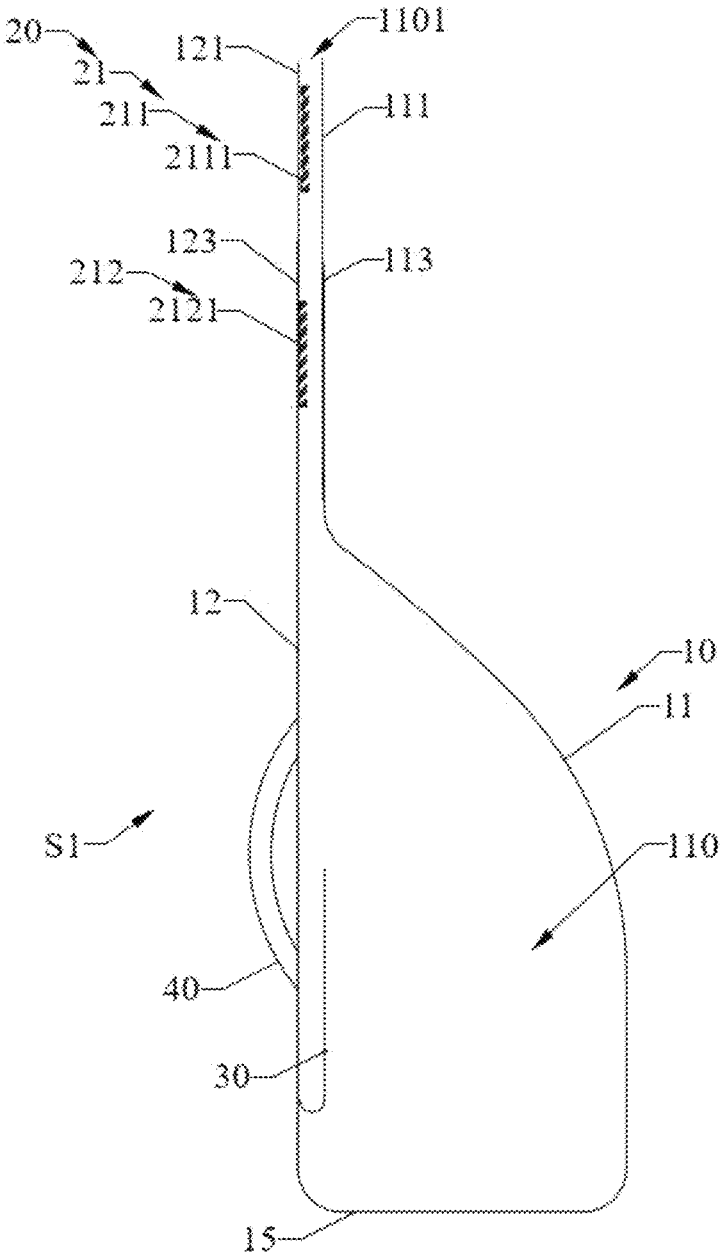
FIG. 29 is a cross-sectional view of the waterproof bag according to a sixteenth embodiment of the present application in a first folded state.

In an embodiment of the present application, as shown in FIG. 29, the first fastening element 211 is disposed on the first folding portion 121; the first mating element 212 is disposed on the rear installation portion 123, without providing the second fastening element 221 and the second mating element 222.

Figure 30:
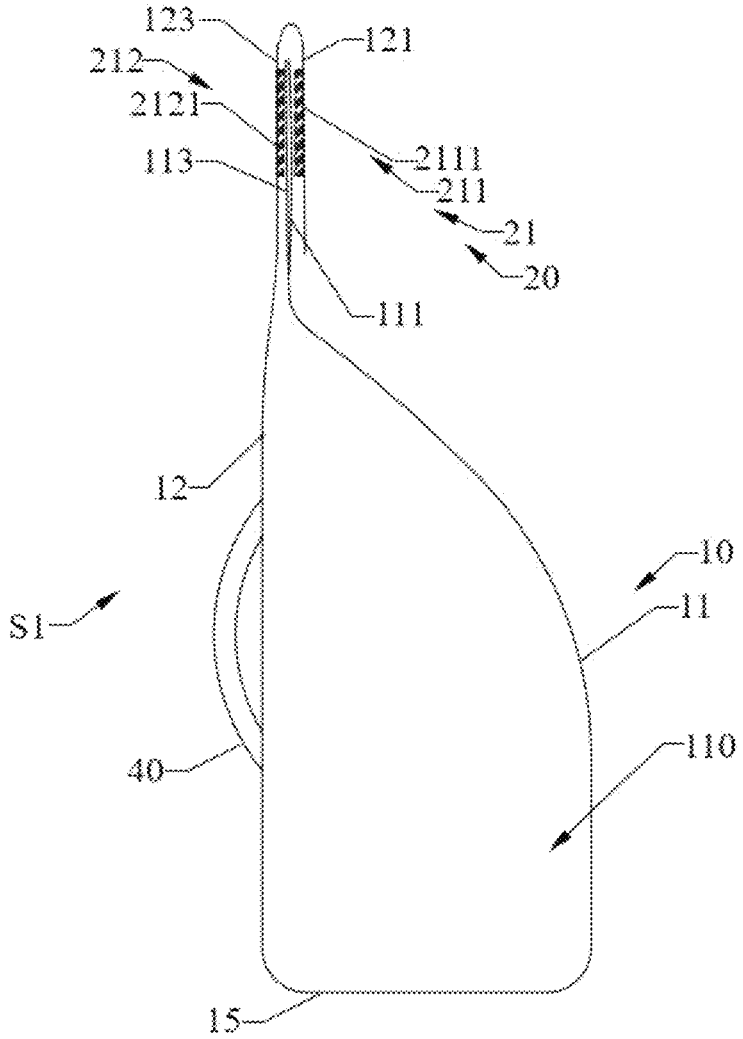
FIG. 30 is a cross-sectional view of the waterproof bag according to the sixteenth embodiment of the present application in an unfolded state.

As shown in FIG. 30, when the waterproof bag is in the first folded state S2, the first folding portion 121 and the first corresponding portion 111 are folded downward to face the rear installation portion 123; the first fastening element 211 is aligned and coupled with the first mating element 212, thereby achieving fastening between the first fastening element 211 and the first mating element 212.

In the embodiments illustrated in FIGS. 29 and 30, the waterproof bag mainly achieves fastening through magnetic attraction structures. Accordingly, the first fastening element 211 comprises a first magnetic attraction element 2111; the first mating element 212 comprises a second magnetic attraction element 2121.

When the main body portion 10 is in the first folded state S2, the first magnetic attraction element 2111 and the second magnetic attraction element 2121 attract each other.

The front surface magnetism of the second magnetic attraction element 2121 is opposite to the front surface magnetism of the first magnetic attraction element 2111.

Accordingly, in one example of the present application, the front surface magnetism of the first magnetic attraction element 2111 is positive; the front surface magnetism of the second magnetic attraction element 2121 is negative.

In another example of the present application, the front surface magnetism of the first magnetic attraction element 2111 is negative; the front surface magnetism of the second magnetic attraction element 2121 is positive.

In one embodiment of the present application, as shown in FIGS. 34 to 40, the fastening assembly 20 further comprises at least one fastening strap 26. The fastening strap 26 is adjustably disposed between the front side portion 11 and the rear side portion 12, and is configured to be switchable between a constrained state and a released state.

In some embodiments of the present application, the waterproof bag can be folded twice, i.e., it can switch between the unfolded state S1, the first folded state S2, and the second folded state S3; one end of the fastening strap 26 is disposed below the second corresponding portion 112, and the other end is disposed on or below the second folding portion 122; when the fastening strap 26 is in the constrained state, it prevents the first corresponding portion 111 and the second folding portion 122 from moving away from the second corresponding portion 112, thereby preventing the waterproof bag from switching from the second folded state S3 to the first folded state S2 or the unfolded state S1; when the fastening strap 26 is in the released state, it allows the first corresponding portion 111 and the second folding portion 122 to move away from the second corresponding portion 112, thereby allowing the waterproof bag to switch from the second folded state S3 to the first folded state S2 or the unfolded state S1.

In some other embodiments of the present application, the waterproof bag can be folded once, i.e., it can switch between the unfolded state S1 and the first folded state S2; one end of the fastening strap 26 is disposed below the front installation portion 113, and the other end is disposed on or below the first folding portion 121, the rear installation portion 123, or below the rear installation portion 123; when the fastening strap 26 is in the constrained state, it prevents the first folding portion 121 and the first corresponding portion 111 from moving away from the second corresponding portion 112, thereby preventing the waterproof bag from switching from the first folded state S2 to the unfolded state S1; when the fastening strap 26 is in the released state, it allows the first folding portion 121 and the first corresponding portion 111 to move away from the second corresponding portion 112, thereby allowing the waterproof bag to switch from the first folded state S2 to the unfolded state S1.

The adjustable arrangement of the fastening strap 26 is not limited by the present application. In some embodiments of the present application, only one end of the fastening strap 26 is adjustably disposed on the main body portion 10. For example, one end of the fastening strap 26 is adjustably disposed on the front side portion 11, and the other end is fixed to the rear side portion 12; alternatively, one end of the fastening strap 26 is adjustably disposed on the rear side portion 12, and the other end is fixed to the front side portion 11. The length of the fastening strap 26 may be adjustable or fixed. By "adjustable length" is mainly meant that its length extending across the front side portion 11 and the rear side portion 12 when in the constrained state is variable.

Figure 34:
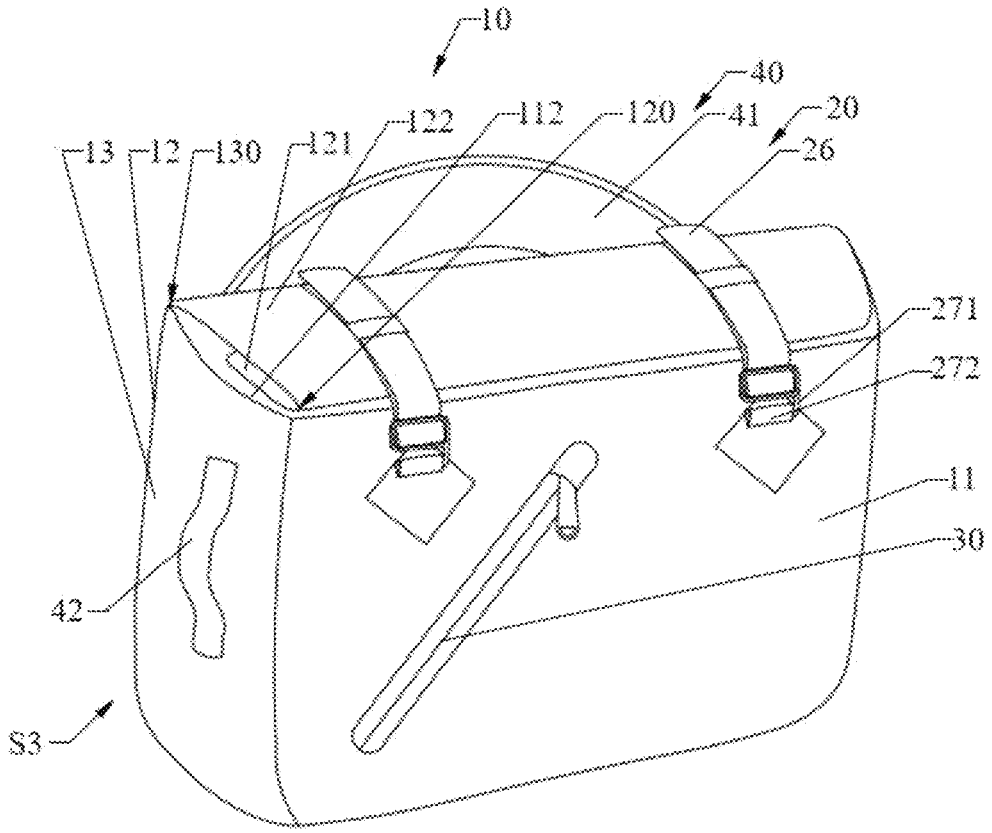
FIG. 34 is a perspective view of the waterproof bag according to a twentieth embodiment of the present application.

As shown in FIG. 34, in an example of the present application, one end of the fastening strap 26 is attached to a hook buckle 271, and the main body portion 10 comprises a hooked part 272, wherein the hook buckle 271 is configured to engage with the hooked part 272; when the hook buckle 271 is engaged with the hooked part 272, the fastening strap 26 is in the constrained state; when the hook buckle 271 disengages from the hooked part 272, the fastening strap 26 is in the released state.

Figure 39:
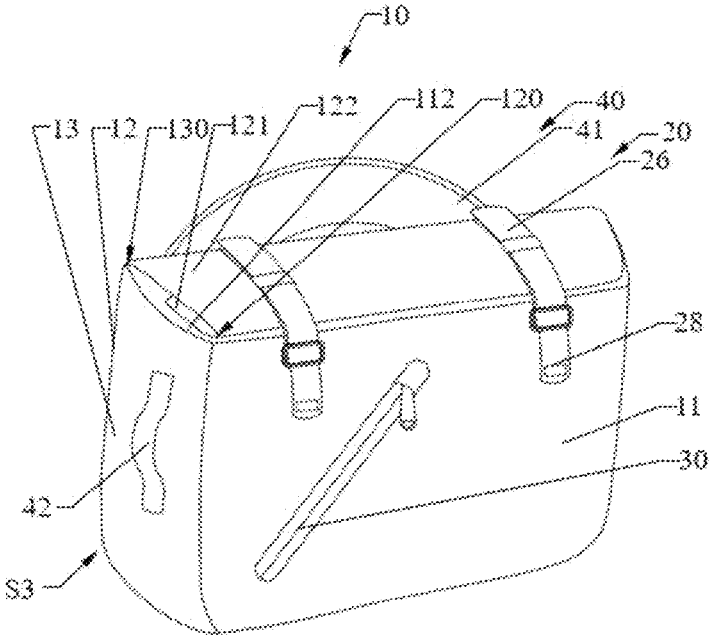
FIG. 39 is a perspective view of the waterproof bag according to a twenty-second embodiment of the present application.

As shown in FIG. 39, in an example of the present application, at least one magnetic attraction element 28 is arranged at one end of the fastening strap 26; at least one magnetic attraction element 28 is arranged on the main body portion 10; the magnetic attraction element 28 arranged on the fastening strap 26 and the magnetic attraction element 28 arranged on the main body portion 10 are adapted to attract each other; when the magnetic attraction element 28 arranged on the fastening strap 26 attracts the magnetic attraction element 28 arranged on the main body portion 10, the fastening strap 26 is in the constrained state; when the magnetic attraction element 28 arranged on the fastening strap 26 separates from the magnetic attraction element 28 arranged on the main body portion 10, the fastening strap 26 is in the released state.

Figure 40:
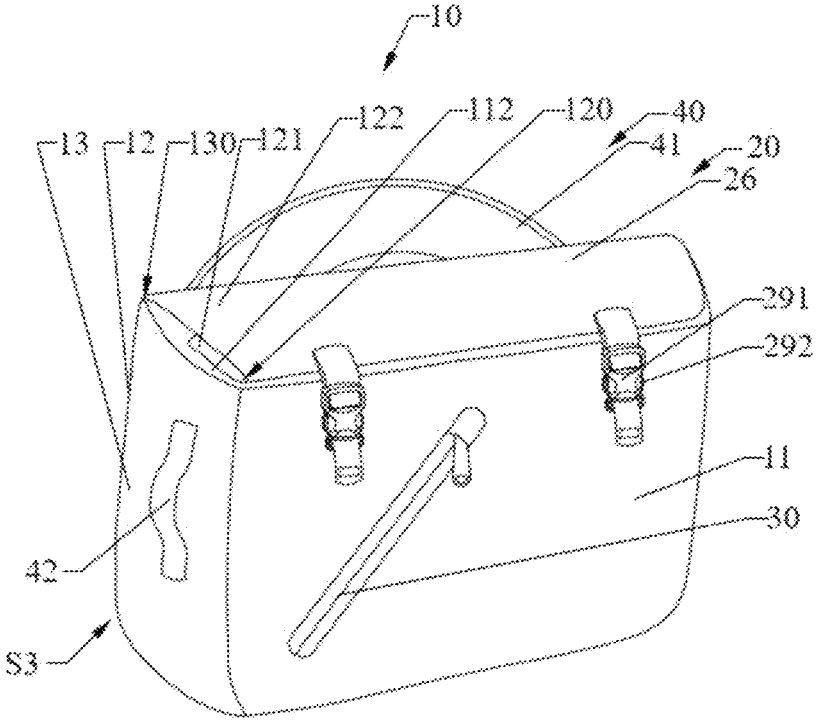
FIG. 40 is a perspective view of the waterproof bag according to a twenty-third embodiment of the present application.

As shown in FIG. 40, in an example of the present application, one end of the fastening strap 26 is attached to a first button element 291, and the main body portion 10 comprises a second button element 292, wherein the first button element 291 and the second button element 292 are adapted to be fastened together; when the first button element 291 is fastened to the second button element 292, the fastening strap 26 is in the constrained state; when the first button element 291 disengages from the second button element 292, the fastening strap 26 is in the released state.

In some embodiments of the present application, one end of the fastening strap 26 is adjustably disposed on the front side portion 11, and the other end is adjustably disposed on the rear side portion 12. In an example of the present application, one end of the fastening strap 26 is attached to a hook buckle 271, and the other end is attached to another hook buckle 271; the front side portion 11 comprises a hooked part 272, and the rear side portion 12 comprises a hooked part 272; the hook buckle 271 is configured to engage with the hooked part 272. The length of the fastening strap 26 may be adjustable or fixed.

In an example of the present application, at least one magnetic attraction element 28 is arranged at one end of the fastening strap 26; at least one magnetic attraction element 28 is arranged at the other end of the fastening strap 26; at least one magnetic attraction element 28 is arranged on the front side portion 11; at least one magnetic attraction element 28 is arranged on the rear side portion 12; the magnetic attraction elements 28 arranged on the fastening strap 26 and those arranged on the main body portion 10 are adapted to attract each other.

In an example of the present application, one end of the fastening strap 26 is attached to a first button element 291, and the front side portion 11 comprises a second button element 292; the other end of the fastening strap 26 is attached to a third button element, and the rear side portion 12 comprises a fourth button element; the first button element 291 and the second button element 292 are adapted to be fastened together; the third button element and the fourth button element are adapted to be fastened together.

In some embodiments of the present application, one end of the fastening strap 26 is fixed to the front side portion 11, and the other end is fixed to the rear side portion 12, wherein the length of the fastening strap 26 is adjustable. For example, the fastening strap 26 may be elastic so that its length is adjustable, or the fastening strap 26 may be mounted on a length-adjusting component. When the fastening strap 26 is in the constrained state, at least a portion of the fastening strap 26 presses against the folded portion of the waterproof bag, for example, the first folding portion 121 and the second folding portion 122. After the length of the fastening strap 26 is extended, the portion pressing against the folded portion of the waterproof bag can be moved laterally, e.g., to the left or right side of the waterproof bag, allowing the folded portion of the waterproof bag to be released from the constraint of the fastening strap 26, placing the fastening strap 26 into the released state.

In one embodiment of the present application, the fastening strap 26 extends circumferentially around the waterproof bag and is detachably disposed on the waterproof bag. When the fastening strap 26 extends circumferentially around the waterproof bag, the fastening strap 26 is in the constrained state; when the fastening strap 26 is detached from the waterproof bag, the fastening strap 26 is in the released state.

Figure 31:
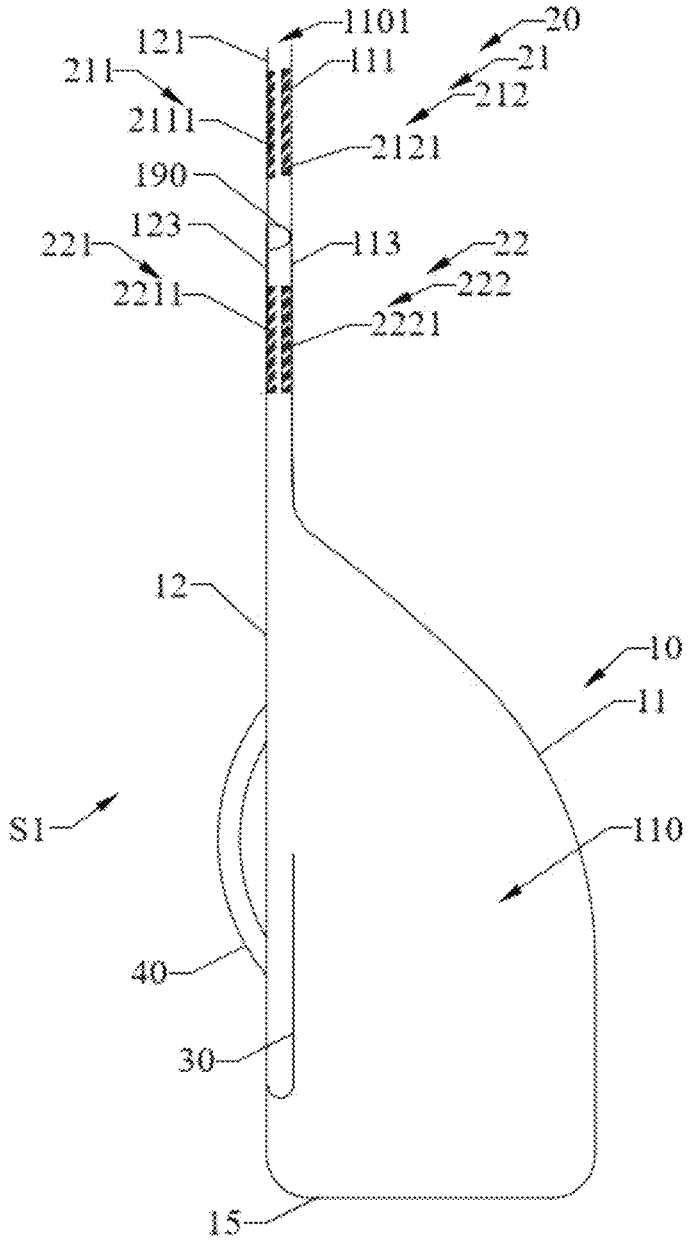
FIG. 31 is a cross-sectional view of the waterproof bag according to a seventeenth embodiment of the present application in an unfolded state.

In an embodiment of the present application, as shown in FIG. 31, at least one air column bag 190 is disposed between the first folding portion 121 and the rear installation portion 123, located on the front side of the rear side portion 12 and facing toward the front side portion 11, such that after the first folding portion 121 is folded, the air column bag 190 closely abuts against the front side portion 11, to prevent liquid from entering the accommodating cavity 110 of the main body portion 10 through a gap between the lower edge of the first folding portion 121 and the front side portion 11.

Figure 32:
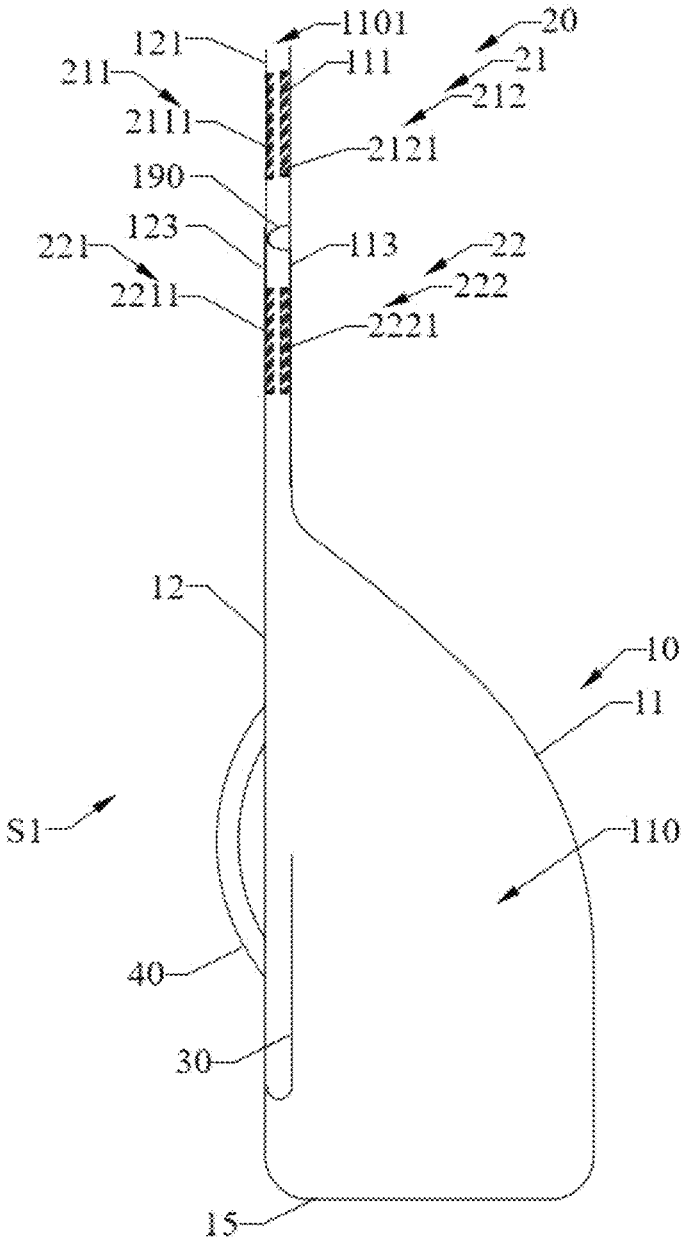
FIG. 32 is a cross-sectional view of the waterproof bag according to an eighteenth embodiment of the present application in an unfolded state.

In another embodiment of the present application, as shown in FIG. 32, at least one air column bag 190 is disposed between the first corresponding portion 111 and the front installation portion 113, located on the rear side of the front side portion 11 and facing toward the rear side portion 12, such that after the first folding portion 121 is folded, the air column bag 190 closely abuts against the rear side portion 12, to prevent liquid from entering the accommodating cavity 110 of the main body portion 10 through a gap between the lower edge of the first corresponding portion 111 and the rear side portion 12.

Figure 33:
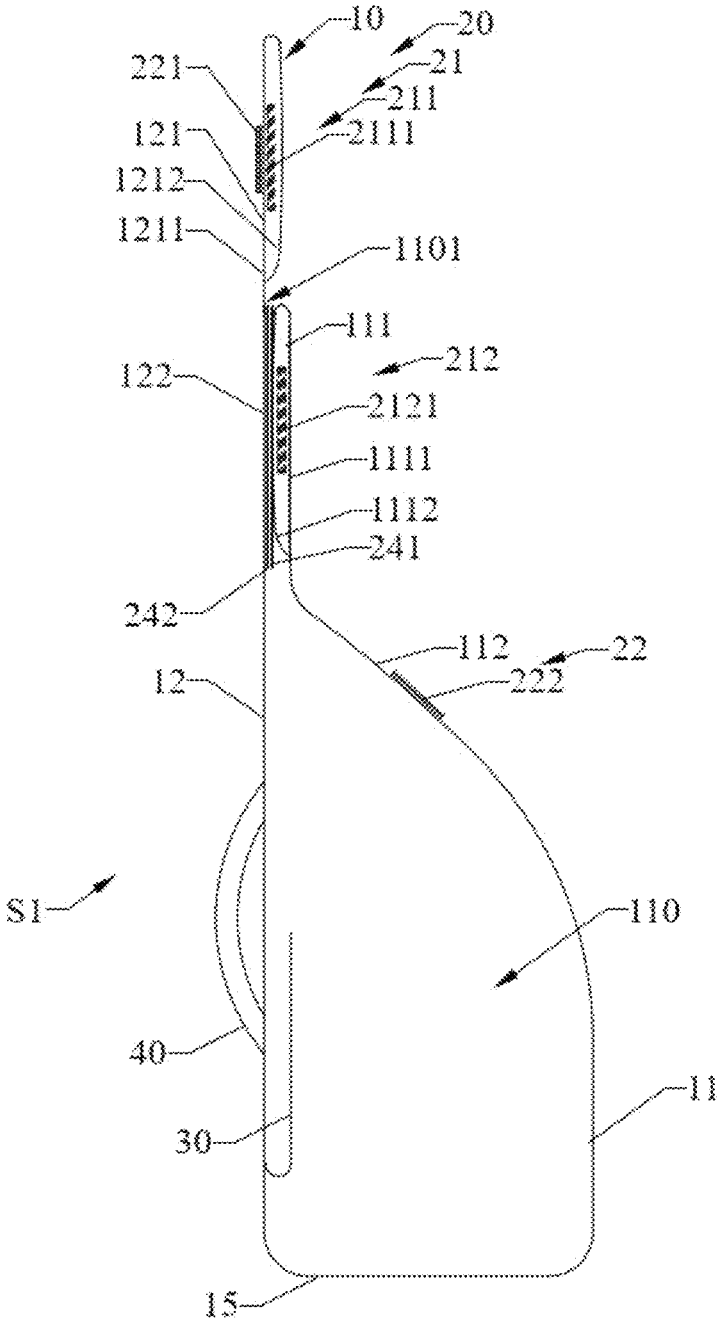
FIG. 33 is a cross-sectional view of the waterproof bag according to a nineteenth embodiment of the present application in an unfolded state.

As shown in FIG. 33, the waterproof bag further comprises at least one front additional film 241 and one rear additional film 242. The front additional film 241 is connected to the front side portion 11 and is located on the rear side of the front side portion 11; the rear additional film 242 is connected to the rear side portion 12 and is located on the front side of the rear side portion 12; the front additional film 241 and the rear additional film 242 are disposed opposite to each other, and when the waterproof bag is in the first folded state S2 and the second folded state S3, the front additional film 241 and the rear additional film 242 are pressed and brought close together, making them difficult to separate under the action of frictional force.

Further, in an example of the present application, the front additional film 241 and the rear additional film 242 are configured to be capable of adhering to each other, which can further reduce the risk of liquid entering the interior of the waterproof bag. The front additional film 241 and the rear additional film 242 mainly adhere to each other through electrostatic forces and van der Waals forces. The material for forming the front additional film 241 is selected from the group consisting of rubber, plastic, silicone, and the like; the material for forming the rear additional film 242 is also selected from the group consisting of rubber, plastic, silicone, and the like. The materials used for forming the front additional film 241 and the rear additional film 242 may be the same or different.

The materials used for forming the front additional film 241 and the rear additional film 242 may be the same as the material used for forming the air column bag 190.

In an embodiment of the present application, the waterproof bag further comprises at least one additional containment cavity 30. The additional containment cavity 30 is optionally disposed within the accommodating cavity 110 of the main body portion 10 and/or outside the main body portion 10.

In the embodiment of the present application, as shown in FIGS. 4 and 34 to 40, the waterproof bag further comprises at least one strap 40. The strap 40 is connected to the main body portion 10, thereby enhancing the portability of the waterproof bag; for example, a user may carry the waterproof bag by means of the strap 40 around the waist, over the shoulder, or in the hand. Further, the length of the strap 40 may be designed to be fixed or adjustable.

In one embodiment of the present application, the at least one strap 40 comprises a shoulder strap 41 and a handle 42. At least one end of the shoulder strap 41 is adjustably disposed on the main body portion 10. The handle 42 is adapted to be carried by hand and may be disposed on the first side portion 13 and/or the second side portion 14, or alternatively at other locations depending on design requirements.

Figure 35:
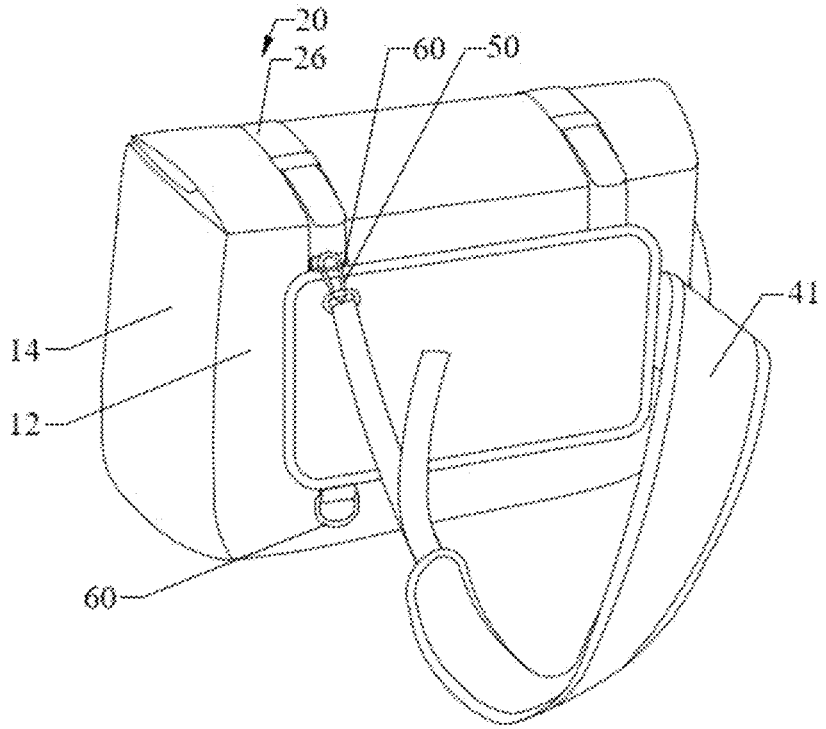
FIG. 35 is another perspective view of the waterproof bag according to a twentieth embodiment of the present application.
Figure 36:
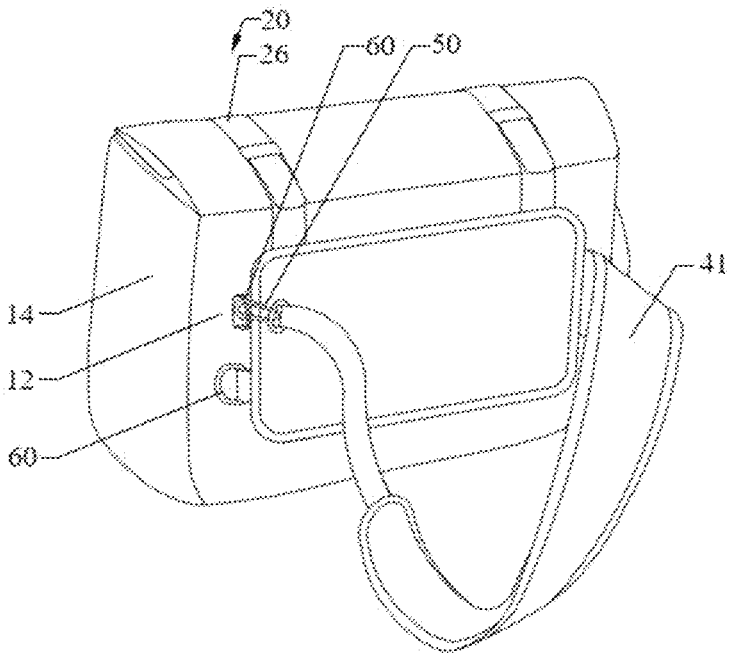
FIG. 36 is a perspective view of the waterproof bag according to a twenty-first embodiment of the present application.

In an example of the present application, one end of the shoulder strap 41 is connected to an adjustable buckle 50, and the main body portion 10 has at least two connection parts 60; the adjustable buckle 50 is adapted to engage with any of the connection parts 60. The positions of the connection parts 60 may be set according to design requirements, as shown in FIGS. 35 and 36.

Figure 37:
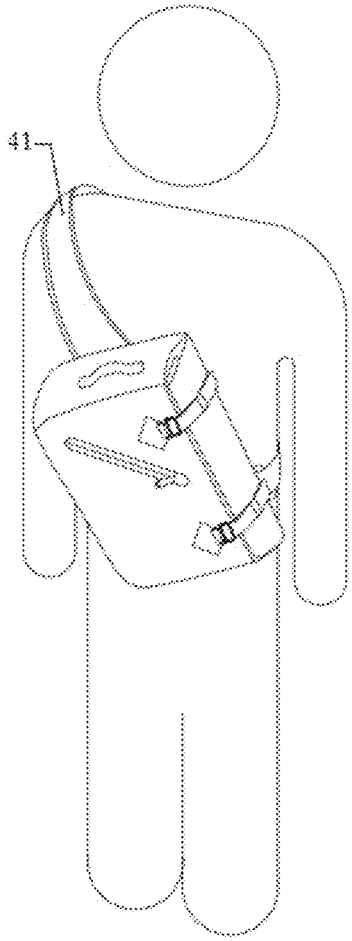
FIG. 37 is a application scenario diagram of the waterproof bag according to a twenty-first embodiment of the present application.
Figure 38:
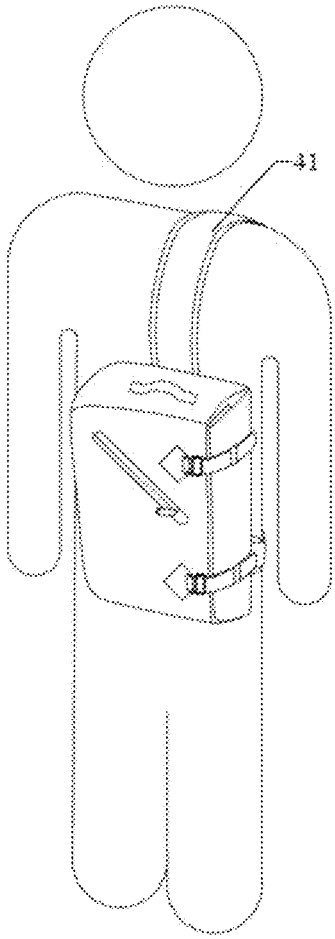
FIG. 38 is another application scenario diagram of the waterproof bag according to a twenty-first embodiment of the present application.

Depending on personal preference or need, the user may sling the waterproof bag across the shoulder via the shoulder strap 41, as shown in FIG. 37, or carry the waterproof bag squarely on the shoulder, as shown in FIG. 38.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention comprises all modifications encompassed within the spirit and scope of the following claims.

What is claimed is:

1. A waterproof bag, comprising:

a main body portion, made of waterproof material, and comprising a front side portion and a rear side portion, and having an accommodating cavity; wherein the front side portion and the rear side portion are connected to each other; the accommodating cavity is located between the front side portion and the rear side portion and has an opening; the opening is located between the front side portion and the rear side portion; the rear side portion extends beyond the front side portion in the height direction of the main body portion and is configured to be foldable at least twice so as to switch the waterproof bag between an unfolded state, a first folded state, and a second folded state; the rear side portion comprises a first folding portion and a second folding portion; the first folding portion extends beyond the front side portion in the height direction of the main body portion; the second folding portion is located below the first folding portion; the front side portion comprises a first corresponding portion and a second corresponding portion; wherein the first corresponding portion is opposite to the second folding portion; the second corresponding portion is located below the first corresponding portion; and a fastening assembly, comprising a first fastening structure pair and a second fastening structure pair; wherein the first fastening structure pair comprises a first fastening element and a first mating element; the second fastening structure pair comprises a second fastening element and a second mating element; wherein the first fastening element and the second fastening element are disposed on the first folding portion; the second mating element is disposed on the main body portion; wherein the first fastening element comprises a first magnetic attraction element, the first mating element comprises a second magnetic attraction element, the first mating element is disposed on the second folding portion;

when the waterproof bag is in the unfolded state, an upper edge of the rear side portion is higher than an upper edge of the front side portion in the height direction of the main body portion; when the waterproof bag is in the first folded state, the first folding portion is folded downward to oppose the first corresponding portion, and the first fastening element couples with the first mating element to close the opening by a magnetic attracting force between the first magnetic attraction element disposed on the first folding portion and the second magnetic attraction element disposed on the second folding portion, wherein the first folding portion and the second folding portion of the rear side portion are located at two opposite sides of the first corresponding portion of the front side portion; when the waterproof bag is in the second folded state, the first folding portion, the first corresponding portion, and the second folding portion are folded downward to oppose the second corresponding portion; and the second fastening element couples with the second mating element.

2. The waterproof bag, as recited in claim 1, wherein the second mating element is disposed on the second corresponding portion; one of the second fastening element and the second mating element has multiple hooks, and the other has multiple loops.

3. The waterproof bag, as recited in claim 2, wherein the first folding portion comprises a first rear main structural layer; the first fastening element is located on a front side of the first rear main structural layer; the second fastening element is set and exposed on a rear side of the first rear main structural layer.

4. The waterproof bag, as recited in claim 3, wherein the first mating element is disposed on the first corresponding portion.

5. The waterproof bag, as recited in claim 3, wherein the second folding portion comprises a second rear main structural layer, the first mating element is disposed on a front side of the second rear main structural layer, located between the second folding portion and the first corresponding portion.

6. The waterproof bag, as recited in claim 1, wherein the second folding portion comprises a second rear main structural layer, the first mating element is disposed on the rear side of the second rear main structural layer.

7. The waterproof bag, as recited in claim 2, further comprising at least one auxiliary magnetic attraction element; wherein the auxiliary magnetic attraction element is disposed on the second corresponding portion, and when the main body portion is in the second folded state, the first magnetic attraction element and the auxiliary magnetic attraction element attract each other.

8. The waterproof bag, as recited in claim 1, wherein the first fastening element comprises a first magnetic attraction element; the first mating element comprises a second magnetic attraction element; the second fastening element comprises a third magnetic attraction element; the second mating element comprises a fourth magnetic attraction element.

9. The waterproof bag, as recited in claim 8, wherein the first magnetic attraction element and the third magnetic attraction element are the same magnetic attraction element.

10. The waterproof bag, as recited in claim 8, wherein the second mating element is disposed on the second corresponding portion.

11. The waterproof bag, as recited in claim 8, wherein the rear side portion further comprises a rear spare installation portion, the rear spare installation portion is located below the second folding portion and opposite to the second corresponding portion, and the second mating element is disposed on the rear spare installation portion.

12. The waterproof bag, as recited in claim 8, wherein the fastening assembly further comprises an additional magnetic attraction element, which faces and attracts the second magnetic attraction element when the waterproof bag is in the unfolded state.

13. The waterproof bag, as recited in claim 1, further comprising at least one air column bag, wherein at least one air column bag is disposed between the front side portion and the rear side portion.

14. The waterproof bag, as recited in claim 12, wherein at least one air column bag is disposed between the first corresponding portion and the second corresponding portion and located on the rear side of the front side portion, facing the rear side portion.

15. The waterproof bag, as recited in claim 12, wherein at least one air column bag is disposed below the second folding portion and located on the front side of the rear side portion, facing the front side portion.

16. The waterproof bag, as recited in claim 12, wherein at least one air column bag is disposed between the first folding portion and the second folding portion and adjacent to the opening.

17. The waterproof bag, as recited in claim 1, further comprising a front additional film and a rear additional film, wherein the front additional film is connected to the front side portion and located on the rear side of the front side portion; the rear additional film is connected to the rear side portion and located on the front side of the rear side portion; the front additional film and the rear additional film are opposite.

18. The waterproof bag, as recited in claim 2, further comprising a front additional film and a rear additional film, wherein the front additional film is connected to the front side portion and located on the rear side of the front side portion; the rear additional film is connected to the rear side portion and located on the front side of the rear side portion; the front additional film and the rear additional film are opposite.

19. The waterproof bag, as recited in claim 1, wherein the fastening assembly further comprises at least one fastening strap adjustably disposed between the front side portion and the rear side portion, and configured to be switchable between a constrained state and a released state; when the fastening strap is in the constrained state, it prevents the waterproof bag from switching from the second folded state to the first folded state or the unfolded state; when the fastening strap is in the released state, it allows the waterproof bag to switch from the second folded state to the first folded state or the unfolded state.

20. The waterproof bag, as recited in claim 1, wherein the second folding portion comprises a second rear main structural layer and a second rear covering layer connected to the second rear main structural layer, wherein the first mating element is disposed between the second rear main structural layer and the second rear covering layer, wherein when the waterproof bag is in the first folded state, the first corresponding portion of the front side portion is located between the second rear covering layer of the second folding portion and the first folding portion of the rear side portion.

21. The waterproof bag, as recited in claim 1, wherein the first folding portion comprises a first rear main structural layer and a first rear covering layer connected to the first rear main structural layer, wherein the first fastening element is disposed between the first rear main structural layer and the first rear covering layer.

22. The waterproof bag, as recited in claim 21, wherein the first folding portion comprises a first rear main structural layer and a first rear covering layer connected to the first rear main structural layer, wherein the first fastening element is disposed between the first rear main structural layer and the first rear covering layer, wherein the first mating element is disposed between the second rear main structural layer and the second rear covering layer, wherein when the waterproof bag is in the first folded state, the first corresponding portion of the front side portion is located between the second rear covering layer of the second folding portion and the first rear covering layer of the first folding portion of the rear side portion, and the first corresponding portion of the front side portion, the second rear covering layer of the second folding portion and the first rear covering layer of the first folding portion of the rear side portion are located between the first magnetic attraction element and the second magnetic attraction element.

* * * * *